US009071019B2

(12) United States Patent
Burris et al.

(10) Patent No.: US 9,071,019 B2
(45) Date of Patent: Jun. 30, 2015

(54) PUSH-ON CABLE CONNECTOR WITH A COUPLER AND RETENTION AND RELEASE MECHANISM

(75) Inventors: Donald Andrew Burris, Peoria, AZ (US); William Bernard Lutz, Glendale, AZ (US)

(73) Assignee: corning Gilbert, Inc., Glendale, AZ (US)

( * ) Notice: Subject to any disclaimer, the term of this patent is extended or adjusted under 35 U.S.C. 154(b) by 0 days.

(21) Appl. No.: 13/281,983

(22) Filed: Oct. 26, 2011

(65) Prior Publication Data

US 2012/0108098 A1 May 3, 2012

Related U.S. Application Data

(60) Provisional application No. 61/407,232, filed on Oct. 27, 2010.

(51) Int. Cl.

| | |
|---|---|
| ***H01R 13/648*** | (2006.01) |
| ***H01R 13/639*** | (2006.01) |
| ***H01R 13/18*** | (2006.01) |
| *H01R 9/05* | (2006.01) |

(52) U.S. Cl.

CPC ..... *H01R 13/639* (2013.01); *H01R 9/0518* (2013.01); *H01R 13/18* (2013.01)

(58) Field of Classification Search

USPC ..... 439/352, 358, 372, 578, 584, 843, 839, 439/378, 382, 583, 607.11, 57, 394, 322, 439/321

See application file for complete search history.

(56) References Cited

U.S. PATENT DOCUMENTS

| | | | |
|---|---|---|---|
| 331,169 | A | 11/1885 | Thomas |
| 346,958 | A | 8/1886 | Stone |
| 459,951 | A | 9/1891 | Warner |
| 589,216 | A | 8/1897 | McKee |
| 1,371,742 | A | 3/1921 | Dringman |
| 1,488,175 | A | 3/1924 | Strandell |
| 1,667,485 | A | 4/1928 | MacDonald |
| 1,766,869 | A | 6/1930 | Austin |
| 1,801,999 | A | 4/1931 | Bowman |

(Continued)

FOREIGN PATENT DOCUMENTS

| | | |
|---|---|---|
| CA | 2096710 | 11/1994 |
| CN | 201149936 | 11/2008 |

(Continued)

OTHER PUBLICATIONS

Lock Washers, ASME B18.21.1-1999, 1999 American Society of Mechanical Engineers, 28 pages.

(Continued)

*Primary Examiner* — Alexander Gilman

(57) ABSTRACT

A cable connector comprising a coupler and a retainer having a base with an internal channel and a latching assembly is disclosed. The coupler has a first end, a second end, and a bore extending therethrough. The latching assembly comprises a beam having a first end and a second end. The latching assembly pivotably connects to the base and has a plurality of teeth extending radially inwardly through a latch slot towards the bore of the coupler. A spring clip radially inwardly biases the coupler. The coupler has at least one compression slot that responds to the radially inwardly bias of the coupler, compressing the coupler radially inwardly and, thereby, providing a resiliently friction fit function to the coupler.

28 Claims, 18 Drawing Sheets

(56) References Cited

U.S. PATENT DOCUMENTS 1,885,761 A 11/1932 Peirce, Jr.
1,959,302 A 5/1934 Paige
2,013,526 A 9/1935 Schmitt
2,059,920 A 11/1936 Weatherhead, Jr.
2,102,495 A 12/1937 England
2,258,528 A 10/1941 Wurzburger
2,258,737 A 10/1941 Browne
2,325,549 A 7/1943 Ryzowitz
2,480,963 A 9/1949 Quinn
2,544,654 A 3/1951 Brown
2,549,647 A 4/1951 Turenne
2,694,187 A 11/1954 Nash
2,705,652 A * 4/1955 Kaiser ..... 285/35
2,754,487 A 7/1956 Carr et al.
2,755,331 A 7/1956 Melcher
2,757,351 A 7/1956 Klostermann
2,762,025 A 9/1956 Melcher
2,785,384 A 3/1957 Wickesser
2,805,399 A 9/1957 Leeper
2,816,949 A 12/1957 Curtiss
2,870,420 A 1/1959 Malek
2,878,039 A 3/1959 Hoegee et al.
2,881,406 A 4/1959 Arson
2,963,536 A 12/1960 Kokalas
3,001,169 A 9/1961 Blonder
3,015,794 A 1/1962 Kishbaugh
3,051,925 A 8/1962 Felts
3,091,748 A 5/1963 Takes et al.
3,094,364 A 6/1963 Lingg
3,103,548 A 9/1963 Concelman
3,184,706 A 5/1965 Atkins
3,194,292 A 7/1965 Borowsky
3,196,382 A 7/1965 Morello, Jr.
3,206,540 A 9/1965 Cohen ..... 174/89
3,245,027 A 4/1966 Ziegler, Jr.
3,275,913 A 9/1966 Blanchard et al.
3,278,890 A 10/1966 Cooney
3,281,756 A * 10/1966 O'Keefe et al. ..... 439/320
3,281,757 A 10/1966 Bonhomme
3,290,069 A 12/1966 Davis
3,292,136 A 12/1966 Somerset
3,320,575 A 5/1967 Brown et al.
3,321,732 A 5/1967 Forney, Jr.
3,336,563 A 8/1967 Hyslop
3,348,186 A 10/1967 Rosen
3,350,667 A 10/1967 Shreve
3,350,677 A 10/1967 Daum
3,355,698 A 11/1967 Keller
3,372,364 A 3/1968 O'Keefe et al.
3,373,243 A 3/1968 Janowiak et al.
3,390,374 A 6/1968 Forney, Jr.
3,406,373 A 10/1968 Forney, Jr.
3,430,184 A 2/1969 Acord
3,448,430 A 6/1969 Kelly
3,453,376 A 7/1969 Ziegler, Jr. et al.
3,465,281 A 9/1969 Florer
3,475,545 A 10/1969 Stark et al.
3,494,400 A 2/1970 McCoy et al.
3,498,647 A 3/1970 Schroder
3,499,671 A 3/1970 Osborne
3,501,737 A 3/1970 Harris et al.
3,517,373 A 6/1970 Jamon
3,526,871 A 9/1970 Hobart
3,533,051 A 10/1970 Ziegler, Jr.
3,537,065 A 10/1970 Winston
3,544,705 A 12/1970 Winston
3,551,882 A 12/1970 O'Keefe
3,564,487 A 2/1971 Upstone et al.
3,587,033 A 6/1971 Brorein et al.
3,601,776 A 8/1971 Curl
3,603,912 A 9/1971 Kelly
3,614,711 A 10/1971 Anderson et al. ..... 339/90 R
3,622,952 A 11/1971 Hilbert
3,629,792 A 12/1971 Dorrell
3,633,150 A 1/1972 Schwartz
3,646,502 A 2/1972 Hutter et al.
3,663,926 A 5/1972 Brandt
3,665,371 A 5/1972 Cripps
3,668,612 A 6/1972 Nepovim
3,669,472 A 6/1972 Nadsady
3,671,922 A 6/1972 Zerlin et al.
3,671,926 A 6/1972 Nepovim
3,678,444 A 7/1972 Stevens et al.
3,678,445 A 7/1972 Brancaleone
3,680,034 A 7/1972 Chow et al.
3,681,739 A 8/1972 Kornick
3,683,320 A 8/1972 Woods et al.
3,686,623 A 8/1972 Nijman
3,694,792 A 9/1972 Wallo
3,694,793 A * 9/1972 Concelman ..... 439/358
3,697,930 A 10/1972 Shirey
3,706,958 A 12/1972 Blanchenot
3,708,186 A 1/1973 Takagi et al.
3,710,005 A 1/1973 French
3,739,076 A 6/1973 Schwartz
3,744,007 A 7/1973 Horak
3,744,011 A 7/1973 Blanchenot
3,761,870 A 9/1973 Drezin et al.
3,778,535 A 12/1973 Forney, Jr.
3,781,762 A 12/1973 Quackenbush
3,781,898 A 12/1973 Holloway
3,783,178 A 1/1974 Philibert et al.
3,787,796 A 1/1974 Barr
3,793,610 A 2/1974 Brishka
3,798,589 A 3/1974 Deardurff
3,808,580 A 4/1974 Johnson
3,810,076 A 5/1974 Hutter
3,835,443 A 9/1974 Arnold et al.
3,836,700 A 9/1974 Niemeyer
3,845,453 A 10/1974 Hemmer
3,846,738 A 11/1974 Nepovim
3,854,003 A 12/1974 Duret
3,854,789 A 12/1974 Kaplan
3,858,156 A 12/1974 Zarro
3,879,102 A 4/1975 Horak
3,886,301 A 5/1975 Cronin et al.
3,907,335 A 9/1975 Burge et al.
3,907,399 A 9/1975 Spinner
3,910,673 A 10/1975 Stokes
3,915,539 A 10/1975 Collins
3,936,132 A 2/1976 Hutter
3,937,547 A 2/1976 Lee-Kemp ..... 339/74 R
3,953,097 A 4/1976 Graham
3,960,428 A 6/1976 Naus et al.
3,963,320 A 6/1976 Spinner
3,963,321 A 6/1976 Burger et al.
3,970,355 A 7/1976 Pitschi
3,972,013 A 7/1976 Shapiro
3,976,352 A 8/1976 Spinner
3,980,805 A 9/1976 Lipari
3,985,418 A 10/1976 Spinner
3,986,736 A 10/1976 Takagi et al.
4,017,139 A 4/1977 Nelson ..... 339/91 R
4,022,966 A 5/1977 Gajajiva
4,030,742 A 6/1977 Eidelberg et al.
4,030,798 A 6/1977 Paoli
4,032,177 A 6/1977 Anderson
4,045,706 A 8/1977 Daffner et al.
4,046,451 A 9/1977 Juds et al.
4,053,200 A 10/1977 Pugner
4,056,043 A 11/1977 Sriramamurty et al. ..... 92/13.2
4,059,330 A 11/1977 Shirey
4,079,343 A 3/1978 Nijman
4,082,404 A 4/1978 Flatt
4,090,028 A 5/1978 Vontobel
4,093,335 A 6/1978 Schwartz et al.
4,100,943 A 7/1978 Terada et al.
4,106,839 A 8/1978 Cooper
4,109,126 A 8/1978 Halbeck
4,125,308 A 11/1978 Schilling
4,126,372 A 11/1978 Hashimoto et al.
4,131,332 A 12/1978 Hogendobler et al.
4,136,897 A 1/1979 Haluch
4,150,250 A 4/1979 Lundeberg

(56) References Cited

U.S. PATENT DOCUMENTS 4,153,320 A 5/1979 Townshend
4,156,554 A 5/1979 Aujla
4,165,911 A 8/1979 Laudig
4,168,921 A 9/1979 Blanchard
4,173,385 A 11/1979 Fenn et al.
4,174,875 A 11/1979 Wilson et al. ..... 339/91 P
4,187,481 A 2/1980 Boutros
4,193,655 A 3/1980 Herrmann, Jr.
4,194,338 A 3/1980 Trafton
4,206,963 A 6/1980 English et al. ..... 339/147 R
4,225,162 A 9/1980 Dola
4,227,765 A 10/1980 Neumann et al. ..... 339/143 R
4,229,714 A 10/1980 Yu
4,250,348 A 2/1981 Kitagawa
4,273,405 A 6/1981 Law
4,280,749 A 7/1981 Hemmer
4,285,564 A 8/1981 Spinner
4,290,663 A 9/1981 Fowler et al.
4,296,986 A 10/1981 Herrmann, Jr.
4,307,926 A 12/1981 Smith
4,309,050 A 1/1982 Legris
4,310,211 A 1/1982 Bunnell et al.
4,322,121 A 3/1982 Riches et al.
4,326,769 A 4/1982 Dorsey et al.
4,334,730 A 6/1982 Colwell et al. ..... 339/130 C
4,339,166 A 7/1982 Dayton
4,346,958 A 8/1982 Blanchard
4,354,721 A 10/1982 Luzzi
4,358,174 A 11/1982 Dreyer
4,373,767 A 2/1983 Cairns
4,389,081 A 6/1983 Gallusser et al.
4,400,050 A 8/1983 Hayward
4,407,529 A 10/1983 Holman
4,408,821 A 10/1983 Forney, Jr.
4,408,822 A 10/1983 Nikitas
4,412,717 A 11/1983 Monroe ..... 339/177 R
4,421,377 A 12/1983 Spinner
4,426,127 A 1/1984 Kubota
4,444,453 A 4/1984 Kirby et al.
4,452,503 A 6/1984 Forney, Jr.
4,456,323 A 6/1984 Pitcher et al.
4,462,653 A 7/1984 Flederbach et al.
4,464,000 A 8/1984 Werth et al.
4,464,001 A 8/1984 Collins
4,469,386 A 9/1984 Ackerman
4,470,657 A 9/1984 Deacon
4,477,132 A 10/1984 Moser et al. ..... 339/14 P
4,484,792 A 11/1984 Tengler et al.
4,484,796 A 11/1984 Sato et al.
4,490,576 A 12/1984 Bolante et al.
4,506,943 A 3/1985 Drogo
4,515,427 A 5/1985 Smit
4,525,017 A 6/1985 Schildkraut et al.
4,531,790 A 7/1985 Selvin
4,531,805 A 7/1985 Werth
4,533,191 A 8/1985 Blackwood
4,540,231 A 9/1985 Forney, Jr.
RE31,995 E 10/1985 Ball
4,545,633 A 10/1985 McGeary ..... 339/42
4,545,637 A 10/1985 Bosshard et al.
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney, Jr. et al.
4,596,434 A 6/1986 Saba et al.
4,596,435 A 6/1986 Bickford
4,597,621 A 7/1986 Burns
4,598,959 A 7/1986 Selvin
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,632,487 A 12/1986 Wargula
4,634,213 A 1/1987 Larsson et al.
4,640,572 A 2/1987 Conlon
4,645,281 A 2/1987 Burger
4,647,135 A 3/1987 Reinhardt
4,650,228 A 3/1987 McMills et al.
4,655,159 A 4/1987 McMills
4,655,534 A 4/1987 Stursa
4,660,921 A 4/1987 Hauver
4,666,190 A 5/1987 Yamabe et al.
4,668,043 A 5/1987 Saba et al.
4,673,236 A 6/1987 Musolff et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gullusser et al.
4,703,988 A 11/1987 Raux et al.
4,713,021 A 12/1987 Kobler
4,717,355 A 1/1988 Mattis ..... 439/452
4,720,155 A 1/1988 Schildkraut et al.
4,728,301 A 3/1988 Hemmer et al. ..... 439/578
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,739,126 A 4/1988 Gutter et al.
4,746,305 A 5/1988 Nomura
4,747,656 A 5/1988 Miyahara et al. ..... 350/96.2
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al. ..... 439/578
4,789,355 A 12/1988 Lee
4,789,759 A 12/1988 Jones
4,795,360 A 1/1989 Newman et al.
4,797,120 A 1/1989 Ulery
4,806,116 A 2/1989 Ackerman
4,807,891 A 2/1989 Neher
4,808,128 A 2/1989 Werth
4,810,017 A * 3/1989 Knak et al. ..... 294/82.27
4,813,886 A 3/1989 Roos et al.
4,820,185 A 4/1989 Moulin
4,834,675 A 5/1989 Samchisen
4,834,676 A 5/1989 Tackett
4,835,342 A 5/1989 Guginsky
4,836,580 A 6/1989 Farrell ..... 285/24
4,836,801 A 6/1989 Ramirez
4,838,813 A 6/1989 Pauza et al.
4,846,731 A 7/1989 Alwine ..... 439/651
4,854,893 A 8/1989 Morris
4,857,014 A 8/1989 Alf et al.
4,867,489 A 9/1989 Patel
4,867,706 A 9/1989 Tang
4,869,679 A 9/1989 Szegda
4,874,331 A 10/1989 Iverson
4,881,912 A 11/1989 Thommen et al. ..... 439/585
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy ..... 439/578
4,927,385 A 5/1990 Cheng
4,929,188 A 5/1990 Lionetto et al.
4,934,960 A 6/1990 Capp et al.
4,938,718 A 7/1990 Guendel ..... 439/680
4,941,846 A * 7/1990 Guimond et al. ..... 439/578
4,952,174 A 8/1990 Sucht et al.

(56) References Cited

U.S. PATENT DOCUMENTS 4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,018,822 A 5/1991 Freismuth et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,139 A 10/1991 Spinner
5,059,747 A 10/1991 Bawa et al.
5,062,804 A 11/1991 Jamet et al.
5,066,248 A 11/1991 Gaver, Jr. et al.
5,067,912 A 11/1991 Bickford et al. ..... 439/578
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,167,545 A 12/1992 O'Brien et al.
5,169,323 A 12/1992 Kawai et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr. ..... 439/578
5,217,392 A 6/1993 Hosler, Sr. ..... 439/585
5,217,393 A 6/1993 Del Negro et al.
5,221,216 A 6/1993 Gabany et al.
5,227,587 A 7/1993 Paterek
5,247,424 A 9/1993 Harris et al.
5,269,701 A 12/1993 Leibfried, Jr.
5,281,762 A 1/1994 Long et al.
5,283,853 A 2/1994 Szegda
5,284,449 A 2/1994 Vaccaro
5,294,864 A 3/1994 Do
5,295,864 A 3/1994 Birch et al.
5,316,348 A 5/1994 Franklin
5,316,494 A 5/1994 Flanagan et al. ..... 439/352
5,318,459 A 6/1994 Shields
5,321,205 A 6/1994 Bawa et al.
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,362,251 A 11/1994 Bielak
5,371,819 A 12/1994 Szegda
5,371,821 A 12/1994 Szegda
5,371,827 A 12/1994 Szegda
5,380,211 A 1/1995 Kawagauchi et al.
5,389,005 A 2/1995 Kodama
5,393,244 A 2/1995 Szegda ..... 439/394
5,397,252 A 3/1995 Wang
5,413,504 A 5/1995 Kloecker et al.
5,431,583 A 7/1995 Szegda
5,435,745 A 7/1995 Booth
5,435,751 A 7/1995 Papenheim et al.
5,435,760 A 7/1995 Miklos
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,488,268 A 1/1996 Bauer et al. ..... 315/70
5,490,033 A 2/1996 Cronin ..... 361/212
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al. ..... 439/248
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al. ..... 439/584
5,595,499 A * 1/1997 Zander et al. ..... 439/352
5,598,132 A 1/1997 Stabile
5,607,320 A 3/1997 Wright
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,649,723 A * 7/1997 Larsson ..... 285/34
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hsu
5,702,263 A 12/1997 Baumann et al.
5,722,856 A 3/1998 Fuchs et al.
5,735,704 A 4/1998 Anthony
5,746,617 A 5/1998 Porter, Jr. et al.
5,746,619 A 5/1998 Harting et al. ..... 439/352
5,769,652 A 6/1998 Wider
5,774,344 A 6/1998 Casebolt
5,775,927 A 7/1998 Wider
5,788,289 A * 8/1998 Cronley ..... 285/102
5,817,978 A 10/1998 Hermant et al. ..... 174/75 C
5,863,220 A 1/1999 Holliday
5,877,452 A 3/1999 McConnell
5,879,191 A 3/1999 Burris
5,882,226 A 3/1999 Bell et al.
5,897,795 A 4/1999 Lu et al.
5,906,511 A 5/1999 Bozzer et al. ..... 439/579
5,917,153 A 6/1999 Geroldinger
5,921,793 A 7/1999 Phillips
5,938,465 A 8/1999 Fox, Sr.
5,944,548 A 8/1999 Saito
5,951,327 A 9/1999 Marik
5,954,708 A 9/1999 Lopez et al. ..... 604/533
5,957,716 A 9/1999 Buckley et al.
5,967,852 A 10/1999 Follingstad et al.
5,975,591 A 11/1999 Guest
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh

(56) References Cited

U.S. PATENT DOCUMENTS 6,032,358 A 3/2000 Wild
6,036,540 A 3/2000 Beloritsky ..... 439/582
6,042,422 A 3/2000 Youtsey
6,048,229 A 4/2000 Lazaro, Jr.
6,053,743 A 4/2000 Mitchell et al.
6,053,769 A 4/2000 Kubota et al.
6,053,777 A 4/2000 Boyle
6,062,607 A 5/2000 Barthlomew ..... 285/93
6,080,015 A 6/2000 Andreescu
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,093,043 A * 7/2000 Gray et al. ..... 439/352
6,095,828 A 8/2000 Burland
6,095,841 A 8/2000 Felps ..... 439/312
6,123,550 A 9/2000 Burkert et al. ..... 439/63
6,123,567 A 9/2000 McCarthy
6,132,234 A * 10/2000 Waidner et al. ..... 439/358
6,146,197 A 11/2000 Holliday et al.
6,152,752 A 11/2000 Fukuda
6,152,753 A 11/2000 Johnson et al.
6,153,830 A 11/2000 Montena
6,162,995 A 12/2000 Bachle et al.
6,164,977 A 12/2000 Lester ..... 439/63
6,174,206 B1 1/2001 Yentile et al. ..... 439/638
6,183,298 B1 2/2001 Henningsen
6,199,913 B1 3/2001 Wang ..... 285/24
6,199,920 B1 3/2001 Neustadtl ..... 285/322
6,210,216 B1 4/2001 Tso-Chin et al.
6,210,219 B1 4/2001 Zhu et al.
6,210,222 B1 4/2001 Langham et al.
6,217,383 B1 4/2001 Holland et al.
6,238,240 B1 5/2001 Yu ..... 439/541.5
6,239,359 B1 5/2001 Lilienthal, II et al.
6,241,553 B1 6/2001 Hsia
6,250,974 B1 * 6/2001 Kerek ..... 439/843
6,257,923 B1 7/2001 Stone et al.
6,261,126 B1 7/2001 Stirling
6,267,612 B1 7/2001 Areykiewicz et al.
6,271,464 B1 8/2001 Cunningham
6,331,123 B1 12/2001 Rodrigues
6,332,815 B1 12/2001 Bruce
6,358,077 B1 3/2002 Young
6,361,348 B1 3/2002 Hall et al. ..... 439/352
6,361,364 B1 3/2002 Holland et al.
6,375,509 B2 4/2002 Mountford
6,394,840 B1 * 5/2002 Gassauer et al. ..... 439/584
6,396,367 B1 5/2002 Rosenberger ..... 333/260
D458,904 S 6/2002 Montena
6,406,330 B2 6/2002 Bruce
6,409,534 B1 6/2002 Weisz-Margulescu ..... 439/367
D460,739 S 7/2002 Fox
D460,740 S 7/2002 Montena
D460,946 S 7/2002 Montena
D460,947 S 7/2002 Montena
D460,948 S 7/2002 Montena
6,422,884 B1 7/2002 Babasick et al. ..... 439/222
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,450,829 B1 9/2002 Weisz-Margulescu ..... 439/352
6,454,463 B1 9/2002 Halbach ..... 385/60
6,464,526 B1 10/2002 Seufert et al. ..... 439/352
6,467,816 B1 10/2002 Huang ..... 285/316
6,468,100 B1 10/2002 Meyer et al.
6,491,546 B1 12/2002 Perry
D468,696 S 1/2003 Montena
6,506,083 B1 1/2003 Bickford et al.
6,520,800 B1 2/2003 Michelbach et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.
6,634,906 B1 10/2003 Yeh
6,663,397 B1 12/2003 Lin et al. ..... 439/63
6,676,446 B2 1/2004 Montena
6,683,253 B1 1/2004 Lee
6,692,285 B2 2/2004 Islam
6,692,286 B1 2/2004 De Cet
6,695,636 B2 2/2004 Hall et al. ..... 439/352
6,705,875 B2 3/2004 Berghorn et al. ..... 439/63
6,705,884 B1 3/2004 McCarthy
6,709,280 B1 3/2004 Gretz
6,712,631 B1 3/2004 Youtsey ..... 439/322
6,716,041 B2 4/2004 Ferderer et al.
6,716,062 B1 4/2004 Palinkas et al.
6,733,336 B1 5/2004 Montena et al.
6,733,337 B2 5/2004 Kodaira
6,752,633 B2 6/2004 Aizawa et al.
6,761,571 B2 7/2004 Hida ..... 439/188
6,767,248 B1 7/2004 Hung
6,769,926 B1 8/2004 Montena
6,780,029 B1 8/2004 Gretz
6,780,042 B1 8/2004 Badescu et al. ..... 439/352
6,780,052 B2 8/2004 Montena et al.
6,780,068 B2 8/2004 Bartholoma et al.
6,786,767 B1 9/2004 Fuks et al.
6,790,081 B2 9/2004 Burris et al.
6,793,528 B2 9/2004 Lin et al. ..... 439/582
6,802,738 B1 10/2004 Henningsen
6,805,584 B1 10/2004 Chen
6,806,531 B1 10/2004 Chen
6,808,415 B1 10/2004 Montena
6,817,272 B2 11/2004 Holland
6,817,896 B2 11/2004 Derenthal
6,827,608 B2 12/2004 Hall et al. ..... 439/578
6,848,115 B2 1/2005 Sugiura et al.
6,848,939 B2 2/2005 Stirling
6,848,940 B2 2/2005 Montena
6,848,941 B2 2/2005 Wlos et al.
6,884,113 B1 4/2005 Montena
6,884,115 B2 4/2005 Malloy
6,887,102 B1 5/2005 Burris et al.
6,929,265 B2 8/2005 Holland et al.
6,929,508 B1 8/2005 Holland
6,935,866 B2 8/2005 Kerekes et al. ..... 439/63
6,939,169 B2 9/2005 Islam et al.
6,942,516 B2 9/2005 Shimoyama et al. ..... 439/352
6,942,520 B2 9/2005 Barlian et al. ..... 439/548
6,945,805 B1 9/2005 Bollinger ..... 439/348
6,948,976 B2 9/2005 Goodwin et al.
6,953,371 B2 10/2005 Baker et al. ..... 439/700
6,955,563 B1 10/2005 Croan ..... 439/578
6,971,912 B2 12/2005 Montena et al.
7,008,263 B2 3/2006 Holland
7,018,216 B1 3/2006 Clark et al. ..... 439/63
7,018,235 B1 3/2006 Burris et al.
7,029,326 B2 4/2006 Montena
7,063,565 B2 6/2006 Ward
7,070,447 B1 7/2006 Montena
7,077,697 B2 7/2006 Kooiman ..... 439/557
7,086,897 B2 8/2006 Montena
7,090,525 B1 8/2006 Morana ..... 439/352
7,094,114 B2 * 8/2006 Kurimoto ..... 439/839
7,097,499 B1 8/2006 Purdy
7,102,868 B2 9/2006 Montena
7,112,078 B2 9/2006 Czikora ..... 439/248
7,112,093 B1 9/2006 Holland
7,114,990 B2 10/2006 Bence et al.
7,118,285 B2 10/2006 Fenwick et al.
7,118,382 B2 10/2006 Kerekes et al. ..... 439/63
7,118,416 B2 10/2006 Montena et al.
7,125,283 B1 10/2006 Lin
7,128,604 B2 10/2006 Hall ..... 439/578
7,131,867 B1 11/2006 Foster et al.

(56) References Cited

U.S. PATENT DOCUMENTS

| | | | | |
|---|---|---|---|---|
| 7,131,868 | B2 | 11/2006 | Montena | |
| 7,140,645 | B2 | 11/2006 | Cronley | 285/34 |
| 7,144,271 | B1 | 12/2006 | Burris et al. | |
| 7,147,509 | B1 | 12/2006 | Burris et al. | |
| 7,156,696 | B1 | 1/2007 | Montena | |
| 7,161,785 | B2 | 1/2007 | Chawgo | |
| 7,165,974 | B2 | 1/2007 | Kooiman | 439/63 |
| 7,173,121 | B2 | 2/2007 | Fang | |
| 7,179,121 | B1 | 2/2007 | Burris et al. | |
| 7,182,639 | B2 | 2/2007 | Burris | |
| 7,189,114 | B1 | 3/2007 | Burris et al. | 439/578 |
| 7,192,308 | B2 | 3/2007 | Rodrigues et al. | 439/578 |
| 7,229,303 | B2 | 6/2007 | Vermoesen et al. | |
| 7,238,047 | B2 | 7/2007 | Saetele et al. | 439/578 |
| 7,252,536 | B2 | 8/2007 | Lazaro, Jr. et al. | |
| 7,252,546 | B1 | 8/2007 | Holland | |
| 7,255,598 | B2 | 8/2007 | Montena et al. | |
| 7,261,594 | B2 | 8/2007 | Kodama et al. | |
| 7,264,502 | B2 | 9/2007 | Holland | |
| 7,278,882 | B1 | 10/2007 | Li | |
| 7,288,002 | B2 | 10/2007 | Rodrigues et al. | 439/578 |
| 7,291,033 | B2 | 11/2007 | Hu | 439/347 |
| 7,299,550 | B2 | 11/2007 | Montena | |
| 7,318,609 | B2 | 1/2008 | Naito et al. | 285/322 |
| 7,322,846 | B2 | 1/2008 | Camelio | 439/352 |
| 7,322,851 | B2 | 1/2008 | Brookmire | 439/578 |
| 7,329,139 | B2 | 2/2008 | Benham | 439/352 |
| 7,335,058 | B1 | 2/2008 | Burris et al. | 439/578 |
| 7,347,129 | B1 | 3/2008 | Youtsey | |
| 7,347,726 | B2 | 3/2008 | Wlos | 439/578 |
| 7,347,727 | B2 * | 3/2008 | Wlos et al. | 439/578 |
| 7,347,729 | B2 | 3/2008 | Thomas et al. | |
| 7,351,088 | B1 | 4/2008 | Qu | 439/352 |
| 7,357,641 | B2 | 4/2008 | Kerekes et al. | 439/63 |
| 7,364,462 | B2 | 4/2008 | Holland | |
| 7,371,112 | B2 | 5/2008 | Burris et al. | 439/578 |
| 7,375,533 | B2 | 5/2008 | Gale | |
| 7,387,524 | B2 | 6/2008 | Cheng | 439/352 |
| 7,393,245 | B2 | 7/2008 | Palinkas et al. | |
| 7,396,249 | B2 | 7/2008 | Kauffman | 439/349 |
| 7,404,737 | B1 | 7/2008 | Youtsey | |
| 7,416,415 | B2 | 8/2008 | Hart et al. | 439/63 |
| 7,438,327 | B2 | 10/2008 | Auray et al. | |
| 7,452,239 | B2 | 11/2008 | Montena | |
| 7,455,550 | B1 | 11/2008 | Sykes | |
| 7,458,850 | B1 | 12/2008 | Burris et al. | 439/582 |
| 7,462,068 | B2 | 12/2008 | Amidon | |
| 7,467,980 | B2 * | 12/2008 | Chiu | 439/843 |
| 7,476,127 | B1 | 1/2009 | Wei | |
| 7,478,475 | B2 | 1/2009 | Hall | 29/869 |
| 7,479,033 | B1 | 1/2009 | Sykes et al. | |
| 7,479,035 | B2 | 1/2009 | Bence et al. | |
| 7,484,988 | B2 * | 2/2009 | Ma et al. | 439/350 |
| 7,484,997 | B2 | 2/2009 | Hofling | 439/578 |
| 7,488,210 | B1 | 2/2009 | Burris et al. | |
| 7,494,355 | B2 | 2/2009 | Hughes et al. | |
| 7,497,729 | B1 | 3/2009 | Wei | |
| 7,500,868 | B2 | 3/2009 | Holland et al. | |
| 7,500,873 | B1 | 3/2009 | Hart | 439/578 |
| 7,507,116 | B2 | 3/2009 | Laerke et al. | |
| 7,507,117 | B2 | 3/2009 | Amidon | |
| 7,513,788 | B2 | 4/2009 | Camelio | 439/352 |
| 7,544,094 | B1 | 6/2009 | Paglia et al. | |
| 7,563,133 | B2 | 7/2009 | Stein | 439/578 |
| 7,566,236 | B2 | 7/2009 | Malloy et al. | |
| 7,568,945 | B2 | 8/2009 | Chee et al. | 439/578 |
| 7,578,693 | B2 | 8/2009 | Yoshida et al. | 439/352 |
| 7,588,454 | B2 | 9/2009 | Nakata et al. | 439/357 |
| 7,607,942 | B1 | 10/2009 | Van Swearingen | |
| 7,625,227 | B1 | 12/2009 | Henderson et al. | 439/350 |
| 7,632,143 | B1 | 12/2009 | Islam | |
| 7,635,283 | B1 | 12/2009 | Islam | |
| 7,651,376 | B2 | 1/2010 | Schreier | |
| 7,674,132 | B1 | 3/2010 | Chen | |
| 7,682,177 | B2 | 3/2010 | Berthet | |
| 7,714,229 | B2 | 5/2010 | Burris et al. | 174/75 C |
| 7,727,011 | B2 | 6/2010 | Montena et al. | |
| 7,749,021 | B2 | 7/2010 | Brodeur | 439/578 |
| 7,753,705 | B2 | 7/2010 | Montena | |
| 7,753,710 | B2 | 7/2010 | George | 439/352 |
| 7,753,727 | B1 | 7/2010 | Islam et al. | |
| 7,758,370 | B1 | 7/2010 | Flaherty | 439/352 |
| 7,794,275 | B2 | 9/2010 | Rodrigues | |
| 7,806,714 | B2 | 10/2010 | Williams et al. | |
| 7,806,725 | B1 | 10/2010 | Chen | |
| 7,811,133 | B2 | 10/2010 | Gray | |
| D626,920 | S | 11/2010 | Purdy et al. | |
| 7,824,216 | B2 | 11/2010 | Purdy | |
| 7,828,595 | B2 | 11/2010 | Mathews | |
| 7,830,154 | B2 | 11/2010 | Gale | |
| 7,833,053 | B2 | 11/2010 | Mathews | |
| 7,845,976 | B2 | 12/2010 | Mathews | |
| 7,845,978 | B1 | 12/2010 | Chen | |
| 7,845,980 | B1 * | 12/2010 | Amidon | 439/587 |
| 7,850,472 | B2 * | 12/2010 | Friedrich et al. | 439/256 |
| 7,850,487 | B1 | 12/2010 | Wei | |
| 7,857,661 | B1 | 12/2010 | Islam | |
| 7,874,870 | B1 | 1/2011 | Chen | |
| 7,887,354 | B2 | 2/2011 | Holliday | |
| 7,892,004 | B2 | 2/2011 | Hertzler et al. | |
| 7,892,005 | B2 | 2/2011 | Haube | |
| 7,892,024 | B1 | 2/2011 | Chen | |
| 7,914,326 | B2 | 3/2011 | Sutter | |
| 7,918,687 | B2 | 4/2011 | Paynter et al. | |
| 7,927,135 | B1 | 4/2011 | Wlos | |
| 7,934,955 | B1 | 5/2011 | Hsia | |
| 7,942,695 | B1 | 5/2011 | Lu | |
| 7,950,958 | B2 | 5/2011 | Mathews | |
| 7,955,126 | B2 | 6/2011 | Bence et al. | |
| 7,972,158 | B2 | 7/2011 | Wild et al. | |
| 7,972,176 | B2 | 7/2011 | Burris et al. | |
| 7,982,005 | B2 | 7/2011 | Ames et al. | |
| 8,011,955 | B1 | 9/2011 | Lu | |
| 8,025,518 | B2 * | 9/2011 | Burris et al. | 439/322 |
| 8,029,315 | B2 | 10/2011 | Purdy et al. | |
| 8,029,316 | B2 | 10/2011 | Snyder et al. | |
| 8,062,044 | B2 | 11/2011 | Montena et al. | |
| 8,062,063 | B2 | 11/2011 | Malloy et al. | |
| 8,070,504 | B2 | 12/2011 | Amidon et al. | |
| 8,075,337 | B2 | 12/2011 | Malloy et al. | |
| 8,075,338 | B1 | 12/2011 | Montena | |
| 8,079,860 | B1 | 12/2011 | Zraik | |
| 8,087,954 | B2 * | 1/2012 | Fuchs | 439/578 |
| 8,113,875 | B2 | 2/2012 | Malloy et al. | |
| 8,157,587 | B2 | 4/2012 | Paynter et al. | |
| 8,157,588 | B1 | 4/2012 | Rodrigues et al. | |
| 8,167,636 | B1 | 5/2012 | Montena | |
| 8,172,612 | B2 | 5/2012 | Bence et al. | |
| 8,177,572 | B2 * | 5/2012 | Feye-Hohmann | 439/268 |
| 8,192,237 | B2 | 6/2012 | Purdy et al. | |
| 8,206,172 | B2 * | 6/2012 | Katagiri et al. | 439/352 |
| D662,893 | S | 7/2012 | Haberek et al. | |
| 8,231,412 | B2 | 7/2012 | Paglia et al. | |
| 8,262,408 | B1 | 9/2012 | Kelly | |
| 8,272,893 | B2 | 9/2012 | Burris et al. | |
| 8,287,320 | B2 | 10/2012 | Purdy et al. | |
| 8,313,345 | B2 | 11/2012 | Purdy | |
| 8,313,353 | B2 | 11/2012 | Purdy et al. | |
| 8,317,539 | B2 | 11/2012 | Stein | 439/578 |
| 8,323,053 | B2 | 12/2012 | Montena | |
| 8,323,058 | B2 | 12/2012 | Flaherty et al. | 439/680 |
| 8,323,060 | B2 | 12/2012 | Purdy et al. | |
| 8,337,229 | B2 | 12/2012 | Montena | |
| 8,376,769 | B2 | 2/2013 | Holland et al. | |
| D678,844 | S | 3/2013 | Haberek | |
| 8,398,421 | B2 | 3/2013 | Haberek et al. | |
| 8,449,326 | B2 | 5/2013 | Holland et al. | |
| 8,469,739 | B2 | 6/2013 | Rodrigues et al. | |
| D686,164 | S | 7/2013 | Haberek et al. | |
| D686,576 | S | 7/2013 | Haberek et al. | |
| 8,480,430 | B2 | 7/2013 | Ehret et al. | |
| 8,506,325 | B2 | 8/2013 | Malloy et al. | |
| 8,517,763 | B2 | 8/2013 | Burris et al. | |
| 8,517,764 | B2 | 8/2013 | Wei et al. | |

(56) References Cited

U.S. PATENT DOCUMENTS

| | | | | |
|---|---|---|---|---|
| 8,529,279 | B2 | 9/2013 | Montena | |
| 8,550,835 | B2 | 10/2013 | Montena | |
| 8,568,163 | B2 | 10/2013 | Burris et al. | 439/578 |
| 8,568,165 | B2 | 10/2013 | Wei et al. | |
| 8,591,244 | B2 | 11/2013 | Thomas et al. | |
| 8,597,050 | B2 | 12/2013 | Flaherty et al. | 439/578 |
| 8,636,529 | B2 | 1/2014 | Stein | 439/252 |
| 8,647,136 | B2 | 2/2014 | Purdy et al. | |
| 8,690,603 | B2 | 4/2014 | Bence et al. | |
| 8,721,365 | B2 | 5/2014 | Holland | |
| 8,727,800 | B2 | 5/2014 | Holland et al. | |
| 8,777,658 | B2 | 7/2014 | Holland et al. | |
| 8,777,661 | B2 | 7/2014 | Holland et al. | |
| 8,858,251 | B2 | 10/2014 | Montena | |
| 8,888,526 | B2 | 11/2014 | Burris | |
| 8,920,192 | B2 | 12/2014 | Montena | |
| 2001/0034143 | A1 | 10/2001 | Annequin | 439/63 |
| 2001/0046802 | A1 | 11/2001 | Perry et al. | 439/352 |
| 2001/0051448 | A1 | 12/2001 | Gonzalez | 439/63 |
| 2002/0013088 | A1 | 1/2002 | Rodrigues et al. | |
| 2002/0019161 | A1 | 2/2002 | Finke et al. | 439/352 |
| 2002/0038720 | A1 | 4/2002 | Kai et al. | |
| 2002/0146935 | A1 | 10/2002 | Wong | |
| 2003/0110977 | A1 | 6/2003 | Batlaw | |
| 2003/0119358 | A1 | 6/2003 | Henningsen | |
| 2003/0139081 | A1 | 7/2003 | Hall et al. | 439/352 |
| 2003/0194890 | A1 | 10/2003 | Ferderer et al. | |
| 2003/0214370 | A1 | 11/2003 | Allison et al. | |
| 2003/0224657 | A1 | 12/2003 | Malloy | |
| 2004/0031144 | A1 | 2/2004 | Holland | |
| 2004/0077215 | A1 | 4/2004 | Palinkas et al. | |
| 2004/0102089 | A1 | 5/2004 | Chee | |
| 2004/0157499 | A1 | 8/2004 | Nania et al. | 439/680 |
| 2004/0194585 | A1 | 10/2004 | Clark | |
| 2004/0209516 | A1 | 10/2004 | Burris et al. | |
| 2004/0219833 | A1 | 11/2004 | Burris et al. | |
| 2004/0229504 | A1 | 11/2004 | Liu | |
| 2005/0042919 | A1 | 2/2005 | Montena | |
| 2005/0079762 | A1 | 4/2005 | Hsia | |
| 2005/0159045 | A1 | 7/2005 | Huang | |
| 2005/0170692 | A1 | 8/2005 | Montena | |
| 2005/0181652 | A1 | 8/2005 | Montena et al. | |
| 2005/0181668 | A1 | 8/2005 | Montena et al. | |
| 2005/0208827 | A1 | 9/2005 | Burris et al. | |
| 2005/0233636 | A1 | 10/2005 | Rodrigues et al. | |
| 2006/0014425 | A1 | 1/2006 | Montena | |
| 2006/0099853 | A1 | 5/2006 | Sattele et al. | |
| 2006/0110977 | A1 | 5/2006 | Matthews | |
| 2006/0154519 | A1 | 7/2006 | Montena | |
| 2006/0166552 | A1 | 7/2006 | Bence et al. | |
| 2006/0178046 | A1 | 8/2006 | Tusini | |
| 2006/0194465 | A1 | 8/2006 | Czikora | 439/248 |
| 2006/0223355 | A1 | 10/2006 | Hirschmann | 439/352 |
| 2006/0246774 | A1 | 11/2006 | Buck | 439/578 |
| 2006/0258209 | A1 | 11/2006 | Hall | 439/578 |
| 2006/0276079 | A1 | 12/2006 | Chen | |
| 2007/0004276 | A1 | 1/2007 | Stein | 439/578 |
| 2007/0026734 | A1 | 2/2007 | Bence et al. | |
| 2007/0049113 | A1 | 3/2007 | Rodrigues et al. | |
| 2007/0054535 | A1 | 3/2007 | Hall et al. | 439/352 |
| 2007/0059968 | A1 | 3/2007 | Ohtaka et al. | 439/352 |
| 2007/0082533 | A1 | 4/2007 | Currier et al. | 439/352 |
| 2007/0087613 | A1 | 4/2007 | Schumacher et al. | 439/352 |
| 2007/0123101 | A1 | 5/2007 | Palinkas | |
| 2007/0155232 | A1 | 7/2007 | Burris et al. | |
| 2007/0173100 | A1 | 7/2007 | Benham | 439/352 |
| 2007/0175027 | A1 | 8/2007 | Khemakhem et al. | |
| 2007/0232117 | A1 | 10/2007 | Singer | 439/352 |
| 2007/0243759 | A1 | 10/2007 | Rodrigues et al. | |
| 2007/0243762 | A1 | 10/2007 | Burke et al. | |
| 2007/0287328 | A1 | 12/2007 | Hart et al. | 439/578 |
| 2008/0032556 | A1 | 2/2008 | Schreier | |
| 2008/0102696 | A1 | 5/2008 | Montena | |
| 2008/0171466 | A1 | 7/2008 | Buck et al. | |
| 2008/0200066 | A1 | 8/2008 | Hofling | 439/578 |
| 2008/0200068 | A1 | 8/2008 | Aguirre | 439/583 |
| 2008/0214040 | A1 | 9/2008 | Holterhoff et al. | 439/352 |
| 2008/0289470 | A1 | 11/2008 | Aston | |
| 2009/0029590 | A1 | 1/2009 | Sykes et al. | |
| 2009/0098770 | A1 | 4/2009 | Bence et al. | |
| 2009/0104801 | A1 | 4/2009 | Silva | 439/108 |
| 2009/0163075 | A1 | 6/2009 | Blew et al. | |
| 2009/0186505 | A1 | 7/2009 | Mathews | |
| 2009/0264003 | A1 | 10/2009 | Hertzler et al. | 439/299 |
| 2009/0305560 | A1 | 12/2009 | Chen | |
| 2010/0007441 | A1 | 1/2010 | Yagisawa et al. | 333/185 |
| 2010/0022125 | A1 | 1/2010 | Burris et al. | |
| 2010/0028563 | A1 | 2/2010 | Ota | |
| 2010/0055978 | A1 | 3/2010 | Montena | |
| 2010/0080563 | A1 | 4/2010 | DiFonzo et al. | |
| 2010/0081321 | A1 | 4/2010 | Malloy et al. | |
| 2010/0081322 | A1 | 4/2010 | Malloy et al. | |
| 2010/0087071 | A1 | 4/2010 | DiFonzo et al. | |
| 2010/0105246 | A1 | 4/2010 | Burris et al. | |
| 2010/0124839 | A1 | 5/2010 | Montena | |
| 2010/0130060 | A1 | 5/2010 | Islam | |
| 2010/0178799 | A1 | 7/2010 | Lee | |
| 2010/0216339 | A1 | 8/2010 | Burris et al. | |
| 2010/0233901 | A1 | 9/2010 | Wild et al. | |
| 2010/0233902 | A1 | 9/2010 | Youtsey | |
| 2010/0233903 | A1 | 9/2010 | Islam | |
| 2010/0255719 | A1 | 10/2010 | Purdy | |
| 2010/0255721 | A1 | 10/2010 | Purdy et al. | |
| 2010/0279548 | A1 | 11/2010 | Montena et al. | |
| 2010/0297871 | A1 | 11/2010 | Haube | |
| 2010/0297875 | A1 | 11/2010 | Purdy et al. | |
| 2010/0304579 | A1 | 12/2010 | Kisling | |
| 2010/0323541 | A1 | 12/2010 | Amidon et al. | |
| 2011/0021072 | A1 | 1/2011 | Purdy | |
| 2011/0021075 | A1 | 1/2011 | Orner et al. | |
| 2011/0027039 | A1 | 2/2011 | Blair | |
| 2011/0039448 | A1 | 2/2011 | Stein | 439/578 |
| 2011/0053413 | A1 | 3/2011 | Mathews | |
| 2011/0074388 | A1 | 3/2011 | Bowman | |
| 2011/0080158 | A1 | 4/2011 | Lawrence et al. | |
| 2011/0111623 | A1 | 5/2011 | Burris et al. | |
| 2011/0111626 | A1 | 5/2011 | Paglia et al. | |
| 2011/0117774 | A1 | 5/2011 | Malloy et al. | |
| 2011/0143567 | A1 | 6/2011 | Purdy et al. | |
| 2011/0151714 | A1 | 6/2011 | Flaherty et al. | 439/578 |
| 2011/0230089 | A1 | 9/2011 | Amidon et al. | |
| 2011/0230091 | A1 | 9/2011 | Krenceski et al. | |
| 2011/0237123 | A1 | 9/2011 | Burris et al. | 439/578 |
| 2011/0237124 | A1 | 9/2011 | Flaherty et al. | 439/578 |
| 2011/0250789 | A1 | 10/2011 | Burris et al. | |
| 2011/0318958 | A1 | 12/2011 | Burris et al. | |
| 2012/0021642 | A1 | 1/2012 | Zraik | |
| 2012/0040537 | A1 | 2/2012 | Burris | |
| 2012/0045933 | A1 | 2/2012 | Youtsey | |
| 2012/0064768 | A1 | 3/2012 | Islam et al. | |
| 2012/0094530 | A1 | 4/2012 | Montena | |
| 2012/0100751 | A1 | 4/2012 | Montena | |
| 2012/0108098 | A1 | 5/2012 | Burris et al. | |
| 2012/0122329 | A1 | 5/2012 | Montena | |
| 2012/0129387 | A1 | 5/2012 | Holland et al. | |
| 2012/0171894 | A1 | 7/2012 | Malloy et al. | |
| 2012/0178289 | A1 | 7/2012 | Holliday | |
| 2012/0202378 | A1 | 8/2012 | Krenceski et al. | |
| 2012/0222302 | A1 | 9/2012 | Purdy et al. | |
| 2012/0225581 | A1 | 9/2012 | Amidon et al. | |
| 2012/0315788 | A1 | 12/2012 | Montena | |
| 2013/0065433 | A1 | 3/2013 | Burris | |
| 2013/0072057 | A1 | 3/2013 | Burris | |
| 2013/0178096 | A1 | 7/2013 | Matzen | |
| 2014/0106612 | A1 | 4/2014 | Burris | |
| 2014/0106613 | A1 | 4/2014 | Burris et al. | |
| 2014/0120766 | A1 | 5/2014 | Meister et al. | |
| 2014/0148051 | A1 | 5/2014 | Bence et al. | |
| 2014/0322968 | A1 | 10/2014 | Burris | |

FOREIGN PATENT DOCUMENTS

| | | |
|---|---|---|
| CN | 201149937 | 11/2008 |
| CN | 201178228 | 1/2009 |

(56) References Cited

FOREIGN PATENT DOCUMENTS

| | | | | |
|---|---|---|---|---|
| CN | 201904508 | | 7/2011 | |
| DE | 47931 | | 10/1888 | |
| DE | 102289 | | 7/1897 | |
| DE | 1117687 | | 11/1961 | |
| DE | 2261973 | | 6/1974 | |
| DE | 3211008 | | 10/1983 | |
| DE | 9001608.4 | | 4/1990 | |
| DE | 4439852 | | 5/1996 | |
| DE | 19957518 | | 9/2001 | |
| EP | 116157 | | 8/1984 | |
| EP | 167738 | | 1/1986 | |
| EP | 72104 | | 2/1986 | |
| EP | 265276 | | 4/1988 | |
| EP | 428424 | | 5/1991 | |
| EP | 1191268 | | 3/2002 | |
| EP | 1501159 | | 1/2005 | |
| EP | 1548898 | | 6/2005 | |
| EP | 1603200 | A1 | 12/2005 | ..... H01R 13/622 |
| EP | 1701410 | | 9/2006 | |
| EP | 2051340 | | 4/2009 | ..... H01R 13/658 |
| FR | 2232846 | | 1/1975 | |
| FR | 2462798 | | 2/1981 | |
| FR | 2494508 | | 5/1982 | |
| GB | 589697 | | 6/1947 | |
| GB | 1087228 | | 10/1967 | |
| GB | 1270846 | | 4/1972 | |
| GB | 1332888 | | 10/1973 | |
| GB | 1401373 | | 7/1975 | |
| GB | 1421215 | | 1/1976 | |
| GB | 2019665 | | 10/1979 | |
| GB | 2079549 | | 1/1982 | |
| GB | 2252677 | | 8/1992 | |
| GB | 2264201 | | 8/1993 | |
| GB | 2331634 | | 5/1999 | |
| GB | 2448595 | | 10/2008 | |
| GB | 2450248 | | 12/2008 | |
| JP | 3280369 | | 12/1991 | |
| JP | 200215823 | | 1/2002 | |
| JP | 4503793 | B | 7/2010 | ..... H01R 17/04 |
| KR | 100622526 | | 9/2006 | |
| TW | 427044 | | 3/2001 | |
| WO | 8700351 | | 1/1987 | |
| WO | 0186756 | | 11/2001 | |
| WO | 02069457 | | 9/2002 | |
| WO | 2004013883 | | 2/2004 | |
| WO | 2006081141 | | 8/2006 | |
| WO | WO2007/062845 | A1 | 6/2007 | ..... H01R 13/627 |
| WO | 2009066705 | | 5/2009 | |
| WO | 2010135181 | | 11/2010 | |
| WO | 2011057033 | | 5/2011 | |
| WO | 2012162431 | | 5/2011 | |
| WO | 2011128665 | | 10/2011 | |
| WO | 2011128666 | | 10/2011 | |
| WO | 2013126629 | | 8/2013 | |

OTHER PUBLICATIONS

Corning Gilbert 2004 OEM Coaxial Products Catalog, Quick Disconnects, 2 pages.

Office Action dated Jun. 12, 2014 pertaining to U.S. Appl. No. 13/795,737.

Office Action dated Aug. 25, 2014 pertaining to U.S. Appl. No. 13/605,481.

Election/Restrictions Requirement dated Jul. 31, 2014 pertaining to U.S. Appl. No. 13/652,969.

Office Action dated Aug. 29, 2014 pertaining to U.S. Appl. No. 13/827,522.

Election/Restrictions Requirement dated Jun. 20, 2014 pertaining to U.S. Appl. No. 13/795,780.

Office Action dated Sep. 19, 2014 pertaining to U.S. Appl. No. 13/795,780.

Office Action dated Oct. 6, 2014 pertaining to U.S. Appl. No. 13/732,679.

Digicon AVL Connector. ARRIS Group Inc. [online] 3 pages. Retrieved from the Internet: <URL: http://www.arrisi.com/special/digiconAVL.asp.

US Office Action, U.S. Appl. No. 10/997,218; Jul. 31, 2006, pp. 1-10.

Society of Cable Telecommunications Engineers, Engineering Committee, Interface Practices Subcommittee; American National Standard; ANSI/SCTE Jan. 2006; Specification for "F" Port, Female, Outdoor. Published Jan. 2006. 9 pages.

U.S. Reexamination Control No. 90/012,300 filed Jun. 29, 2012, regarding U.S. Patent No. 8,172,612 filed May 27, 2011 (Bence et al.).

U.S. Reexamination Control No. 90/012,749 filed Dec. 21, 2012, regarding U.S. Patent No. 7,114,990, filed Jan. 25, 2005 (Bence et al.).

U.S. Reexamination Control No. 90/012,835 filed Apr. 11, 2013, regarding U.S. Patent No. 8,172,612 filed May 27, 2011 (Bence et al.).

Notice of Allowance (Mail Date Mar. 20, 2012) for U.S. Appl. No. 13/117,843.

Search Report dated Jun. 6, 2014 pertaining to International application No. PCT/US2014/023374.

Search Report dated Apr. 9, 2014 pertaining to International application No. PCT/US2014/015934.

Society of Cable Telecommunications Engineers, Engineering Committee, Interface Practices Subcommittee; American National Standard; ANSI/SCTE Feb. 2006; "Specification for "F" Port, Female, Indoor". Published Feb. 2006. 9 pages.

PPC, "Next Generation Compression Connectors," pp. 1-6, Retrieved from http://www.tessco.com/yts/partnearnanufacturer list/vendors/ppc/pdf/ppc digitalspread.pdf.

Patent Cooperation Treaty, International Search Report for PCT/US2013/070497, Feb. 11, 2014, 3 pgs.

Patent Cooperation Treaty, International Search Report for PCT/US2013/064515, 10 pgs.

Patent Cooperation Treaty, International Search Report for PCT/US2013/064512, Jan. 21, 2014, 11 pgs.

Huber+Suhner AG, RF Connector Guide: Understanding connector technology, 2007, Retrieved from http://www.ie.itcr.ac.cr/marin/lic/e14515/HUBER+SUENER_RF_CONNECTOR_GUIDE.pdf.

Slade, Paul G,. Electrical Contacts: Principles and Applications, 1999, Retrieved from http://books.google.com/books (table of contents only).

U.S. Reexamination Control No. 95/002,400 filed Sep. 15, 2012, regarding U.S. Patent No. 8,192,237 filed Feb. 23, 2011 (Purdy et al.).

U.S. Reexamination Control No. 90/013,068 filed Nov. 27, 2013, regarding U.S. Patent No. 6,558,194 filed Jul. 21, 2000 (Montena).

U.S. Reexamination Control No. 90/013,069 filed Nov. 27, 2013, regarding U.S. Patent No. 6,848,940 filed Jan. 21, 2003 (Montena).

U.S. Inter Partes Review Case No. 2013-00346 filed Jun. 10, 2013, regarding U.S. Patent No. 8,287,320 filed Dec. 8, 2009, claims 1-8, 10-16, 18-31 (Purdy et al.).

U.S. Inter Partes Review Case No. 2013-00343 filed Jun. 10, 2013, regarding U.S. Patent No. 8,313,353 filed Apr. 30, 2012, claims 1-6 (Purdy et al.).

U.S. Inter Partes Review Case No. 2013-00340 filed Jun. 10, 2013, regarding U.S. Patent No. 8,323,060 filed Jun. 14, claims 1-9 (Purdy et al.).

U.S. Inter Partes Review Case No. 2013-00347 filed Jun. 10, 2013, regarding U.S. Patent No. 8,287,320 filed Dec. 8, 2009, claims 9, 17, 32 (Purdy et al.).

U.S. Inter Partes Review Case No. 2013-00345 filed Jun. 10, 2013, regarding U.S. Patent No. 8,313,353 filed Apr. 30, 2012, claims 7-27 (Purdy et al.).

U.S. Inter Partes Review Case No. 2013-00342 filed Jun. 10, 2013, regarding U.S. Patent No. 8,323,060 filed Jun. 14, 2012, claims 10-25 (Purdy et al.).

U.S. Inter Partes Review Case No. 2014-00441 filed Feb. 18, 2014, regarding U.S. Patent No. 8,562,366 filed Oct. 15, 2012, claims 31,37, 39, 41, 42, 55 56 (Purdy et al.).

U.S. Inter Partes Review Case No. 2014-00440 filed Feb. 18, 2014, regarding U.S. Patent No. 8,597,041 filed Oct. 15, 2012, claims 1, 8, 9, 11, 18-26, 29 (Purdy et al.).

(56) References Cited

OTHER PUBLICATIONS

Office Action dated Dec. 31, 2014 pertaining to U.S. Appl. No. 13/605,498.
Office Action dated Dec. 16, 2014 pertaining to U.S. Appl. No. 13/653,095.
Office Action dated Dec. 19, 2014 pertaining to U.S. Appl. No. 13/652,969.
Office Action dated Dec. 29, 2014 pertaining to U.S. Appl. No. 13/833,793.
Corning Cabelcon waterproof CX3 7.0 QuickMount for RG6 cables; Cabelcon Connectors; www.cabelcom.dk; Mar. 15, 2012.
Maury Jr., M.; Microwave Coaxial Connector Technology: A Continuaing Evolution; Maury Microwave Corporation; Dec. 13, 2005; pp. 1-21; Maury Microwave Inc.
"Snap-On/Push-On" SMA Adapter; RF TEC Mfg., Inc.; Mar. 23, 2006; 2 pgs.
RG6 quick mount data sheet; Corning Cabelcon; 2010; 1 pg.; Corning Cabelcon ApS.
RG11 quick mount data sheet; Corning Cabelcon; 2013; 1 pg.; Corning Cabelcon ApS.
Gilbert Engineering Co., Inc.; OEM Coaxial Connectors catalog; Aug. 1993; p. 26.
UltraEase Compression Connectors; "F" Series 59 and 6 Connectors Product Information; May 2005; 4 pgs.
Pomona Electronics Full Line Catelog; vol. 50; 2003; pp. 1-100.
Notice of Allowance dated Feb. 2, 2015 pertaining to U.S. Appl. No. 13/795,737.
Office Action dated Feb. 25, 2015 pertaining to U.S. Appl. No. 13/605,481.
Office Action dated Feb. 18, 2015 pertaining to U.S. Appl. No. 13/827,522.

* cited by examiner

PUSH-ON CABLE CONNECTOR WITH A COUPLER AND RETENTION AND RELEASE MECHANISM

RELATED APPLICATIONS

This application claims the benefit of priority under 35 U.S.C. §119 of U.S. Provisional Application Ser. No. 61/407,232 filed on Oct. 27, 2010 the content of which is relied upon and incorporated herein by reference in its entirety.

BACKGROUND OF THE INVENTION

1. Field of the Invention

The field of the disclosure relates to electrical cable connectors. More particularly, the disclosure relates to a push-on coaxial cable connector with a compression type coupler and a retention and release mechanism that automatically and securely latches the connector to an equipment port when pushed-on the equipment port and remains latched until intentionally released by manipulating the mechanism.

2. Technical Background

Coaxial cable connectors, such as type F connectors, are used to attach coaxial cable to another object or appliance, e.g., a television set, DVD player, modem or other electronic communication device having a terminal adapted to engage the connector. The terminal of the appliance includes an inner conductor and a surrounding outer conductor.

Coaxial cable includes a center conductor for transmitting a signal. The center conductor is surrounded by a dielectric material, and the dielectric material is surrounded by an outer conductor; this outer conductor may be in the form of a conductive foil and/or braided sheath. The outer conductor is typically maintained at ground potential to shield the signal transmitted by the center conductor from stray noise, and to maintain a continuous desired impedance over the signal path. The outer conductor is usually surrounded by a plastic cable jacket that electrically insulates, and mechanically protects, the outer conductor. Prior to installing a coaxial connector onto an end of the coaxial cable, the end of the coaxial cable is typically prepared by stripping off the end portion of the jacket to expose the end portion of the outer conductor. Similarly, it is common to strip off a portion of the dielectric to expose the end portion of the center conductor.

Coaxial cable connectors of the type known in the trade as "F connectors" often include a tubular post designed to slide over the dielectric material, and under the outer conductor of the coaxial cable, at the prepared end of the coaxial cable. If the outer conductor of the cable includes a braided sheath, then the exposed braided sheath is usually folded back over the cable jacket. The cable jacket and folded-back outer conductor extend generally around the outside of the tubular post and are typically received in an outer body of the connector; this outer body of the connector is usually fixedly secured to the tubular post. A coupler is typically rotatably secured around the tubular post and includes an internally-threaded region for engaging external threads formed on the outer conductor of the appliance terminal.

When connecting the end of a coaxial cable to a terminal of a television set, equipment box, or other appliance, it is important to achieve a reliable electrical connection between the outer conductor of the coaxial cable and the outer conductor of the appliance terminal. Typically, this goal is achieved by ensuring the coupler of the connector is fully tightened over the connection port of the appliance. When fully tightened, the head of the tubular post of the connector directly engages the edge of the outer conductor of the appliance port, thereby making a direct electrical ground connection between the outer conductor of the appliance port and the tubular post; in turn, the tubular post is engaged with the outer conductor of the coaxial cable.

With the increased use of self-install kits provided to home owners by some CATV system operators has come a rise in customer complaints due to poor picture quality and/or poor data performance in computer/internet systems. Additionally, CATV system operators have found upstream data problems induced by entrance of unwanted RF signals into their systems. Complaints of this nature result in CATV system operators having to send a technician to address the issue. Often times it is reported by the technician that the cause of the problem is due to a loose F connector fitting, sometimes as a result of inadequate installation of the self-install kit by the home owner. An improperly installed or loose connector may result in poor signal transfer because there are discontinuities along the electrical path between the devices, resulting in ingress of undesired radio frequency ("RF") signals where RF energy from an external source or sources may enter the connector/cable arrangement causing a signal to noise ratio problem resulting in an unacceptable picture or data performance. Many of the current state of the art F connectors rely on intimate contact between the F male connector interface and the F female connector interface. If, for some reason, the connector interfaces are allowed to pull apart from each other, such as in the case of a loose F male coupler, an interface "gap" may result. If not otherwise protected this gap can be a point of RF ingress as previously described.

As mentioned above, the coupler is rotatably secured about the head of the tubular post. The head of the tubular post usually includes an enlarged shoulder, and the coupler typically includes an inwardly-directed flange for extending over and around the shoulder of the tubular post. In order not to interfere with free rotation of the coupler, manufacturers of such F-style connectors routinely make the outer diameter of the shoulder (at the head of the tubular post) of smaller dimension than the inner diameter of the central bore of the coupler. Likewise, manufacturers routinely make the inner diameter of the inwardly-directed flange of the coupler of larger dimension than the outer diameter of the non-shoulder portion of the tubular post, again to avoid interference with rotation of the coupler relative to the tubular post. In a loose connection system, wherein the coupler of the coaxial connector is not drawn tightly to the appliance port connector, an alternate ground path may fortuitously result from contact between the coupler and the tubular post, particularly if the coupler is not centered over, and axially aligned with, the tubular post. However, this alternate ground path is not stable, and can be disrupted as a result of vibrations, movement of the appliance, movement of the cable, or the like.

Alternatively, there are some cases in which such an alternate ground path is provided by fortuitous contact between the coupler and the outer body of the coaxial connector, provided that the outer body is formed from conductive material. This alternate ground path is similarly unstable, and may be interrupted by relative movement between the appliance and the cable, or by vibrations. Moreover, this alternate ground path does not exist at all if the outer body of the coaxial connector is constructed of non-conductive material. Such unstable ground paths can give rise to intermittent failures that are costly and time-consuming to diagnose.

One method used to ensure reliable electrical and mechanical communication between the coupler and the post of the coaxial connector has been to utilize an o-ring as a means to force the coupler proximate the post by means of axially compressing the o-ring. While this method works well to address the electrical concerns noted above it can result in situations where the coupler is more difficult to rotate as compared to other type F connectors in the marketplace.

Alternatively, Male Type F connectors are available with spring fingers which form an interference fit when pushed over the outer threaded portion of a female Type F receptacle. Type F connectors comprising spring fingers may be of dubious reliability because interface retention at the junction relies upon the interference fit between the spring fingers and the threaded outer portion of the port. The amount of retention is typically a compromise between ease of insertion and retention. Typically this type of solution is found in an adaptor that does not attach directly to a coaxial cable, but, rather, adapts a cable connector interface to a push-on interface simply moving the problem of a loose coupler down the line. The push on interface itself does, however, address one basic problem; that of a loose threaded coupler at the immediate junction. By eliminating the threaded coupler issues of improper installation, intermittent connection and RF ingress are at least partially addressed albeit the challenge of connector retention remains.

Additionally, there appears to be no means in the art offered to directly attach a self-retaining yet easily disengaged push-on interface directly to a coaxial cable in the field.

SUMMARY OF THE DETAILED DESCRIPTION

Embodiments disclosed in the detailed description include a push-on cable connector having a retention mechanism. According to one embodiment a cable connector having a coupler and a retainer is provided. The coupler has a first end and a second end. The first end is adapted to receive an end of a cable. A retainer attaches to the coupler. The retainer has a pivotable latching assembly. When a force is applied to the latching assembly, the latching assembly pivots in a direction moving from a first position. When the force is removed from the latching assembly, the latching assembly pivots in an opposite direction moving toward the first position. The first position may be a latched position or an un-latched position. The coupler is radially inward biased allowing the coupler to provide a resilient friction fit function. The coupler is adapted to receive a component, for example, such as an equipment port of an appliance. In this manner, when the equipment port is received by the coupler, the coupler compresses around the equipment port so that the equipment port is resiliently friction fitted to the connector. The latching assembly is adapted to automatically engage the equipment port, when it is received by the connector. The latch assembly is adapted to releasably retain the equipment port to the retainer. The latch assembly may be adapted to engage a thread of the equipment port.

According to another embodiment a cable connector having a coupler with a first end, a second end, and a bore extending therethrough, and a retainer is provided. The second end is radially inwardly biased. The retainer has a base with an internal channel and a latching assembly pivotably connected to the shaft. The first end of the body positions within the channel of the base. The latching assembly has a plurality of teeth extending radially inwardly towards the bore of the coupler proximate the coupler. The latching assembly is configured to automatically latch the retainer to a component, such as, for example, an equipment port of an appliance using at least one of the plurality of teeth. The latching assembly is configured to unlatch the retainer from the component by applying a force to the latching assembly.

The latch assembly comprises a beam having a first end and a second end. The plurality of teeth extends from the second end of the beam. The latch assembly pivotably connects to the base at a location on the beam between the first end and the second end of the beam. The first end of the beam has a grip portion adapted for receiving force applied to the beam to pivot the beam and, thereby, unlatch the retainer. The coupler also has a tubular post attached. The tubular post extends from the first end through the channel and is adapted to receive an end of a cable. A spring clip attaches at least partially around the coupler and may be one of the ways for providing the radially inwardly bias to the coupler. The coupler is adapted to receive the equipment port such that the equipment port is resiliently friction fitted to the connector. The latch assembly is adapted to engage a thread of the equipment port with at least one of a plurality of teeth engages a thread of the equipment port.

In another embodiment, a cable connector comprising a coupler and a retainer having a base with an internal channel and a latching assembly is provided. The coupler has a first end, a second end, and a bore extending therethrough. The second end is radially inwardly biased. The first end of the coupler positions within the channel of the base. The latching assembly comprises a beam having a first end and a second end. The latch assembly pivotably connects to the base at a location on the beam between the first end and the second end of the beam. The latching assembly has a plurality of teeth extending radially inwardly from the second end of the beam towards the bore of the coupler proximate to the coupler. The beam may be a plurality of beams. The coupler has an annular groove. A spring clip positions in the annular groove at least partially around the coupler and provides the radially inwardly bias to the coupler. The coupler has at least one latch slot, wherein the at least one of the plurality of teeth extends radially inwardly through the at least one latch slot into the bore. The coupler has at least one compression slot, wherein the at least one compression slot responds to the radially inwardly bias of the coupler, compressing the coupler radially inwardly and, thereby, providing a resiliently friction fit function to the coupler. The base has one or more strain relief slots formed therein. The at least one of the plurality of teeth may extend past the second end of the body.

Additional features and advantages will be set forth in the detailed description which follows, and in part will be readily apparent to those skilled in the art from that description or recognized by practicing the embodiments as described herein, including the detailed description that follows, the claims, as well as the appended drawings.

It is to be understood that both the foregoing general description and the following detailed description present embodiments, and are intended to provide an overview or framework for understanding the nature and character of the disclosure. The accompanying drawings are included to provide a further understanding, and are incorporated into and constitute a part of this specification. The drawings illustrate various embodiments, and together with the description serve to explain the principles and operation of the concepts disclosed.

DETAILED DESCRIPTION

Reference will now be made in detail to the embodiments, examples of which are illustrated in the accompanying drawings, in which some, but not all embodiments are shown. Indeed, the concepts may be embodied in many different forms and should not be construed as limiting herein; rather, these embodiments are provided so that this disclosure will satisfy applicable legal requirements. Whenever possible, like reference numbers will be used to refer to like components or parts.

Figure 1:
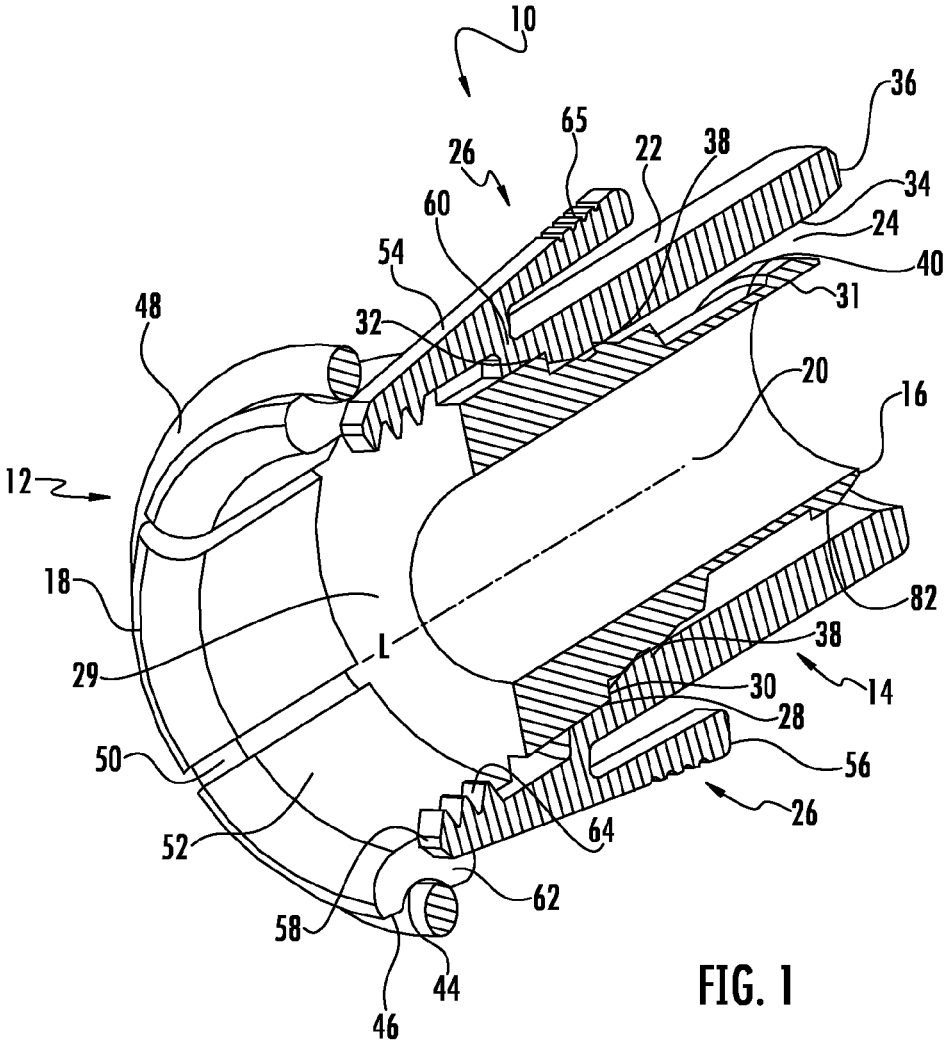
FIG. 1 is a perspective cross sectional view of an exemplary embodiment of a push-on cable connector with a coupler and a retention and release mechanism.

FIG. 1 is a perspective cross sectional view of an exemplary embodiment of a push-on cable connector with a coupler and a retention and release mechanism. The cable connector is intended to be used to connect a cable, for example, without limitation, a coaxial cable, to a component, for example, without limitation, an equipment port of an appliance. In this regard, the connector 10 has a coupler 12 and a retainer 14. The coupler 12 has a first end 16 and a second end 18. The first end 16 is adapted to receive an end of the cable, while the second end 18 is adapted to receive the component, including the equipment port. A bore 20 extends through the coupler 12 from the first end 16 through the second end 18. The bore 20 may be used for the passage of portions of the cable, to secure the cable (not shown in FIG. 1) to the connector 10, provide for the passage of the conductor of the cable, and establish the electrical connectivity, mechanical connection, grounding continuity and RF protection of the cable with the connector and, thereby, with the equipment port. The attachment of a cable to the connector is discussed in more detail with reference to FIG. 5, below. The coupler 12 may be made from metallic material such as brass and plated with a conductive corrosion resistant material, such as tin. The retainer 14 may be made from a resilient polymer material such as acetyl.

Figure 2:
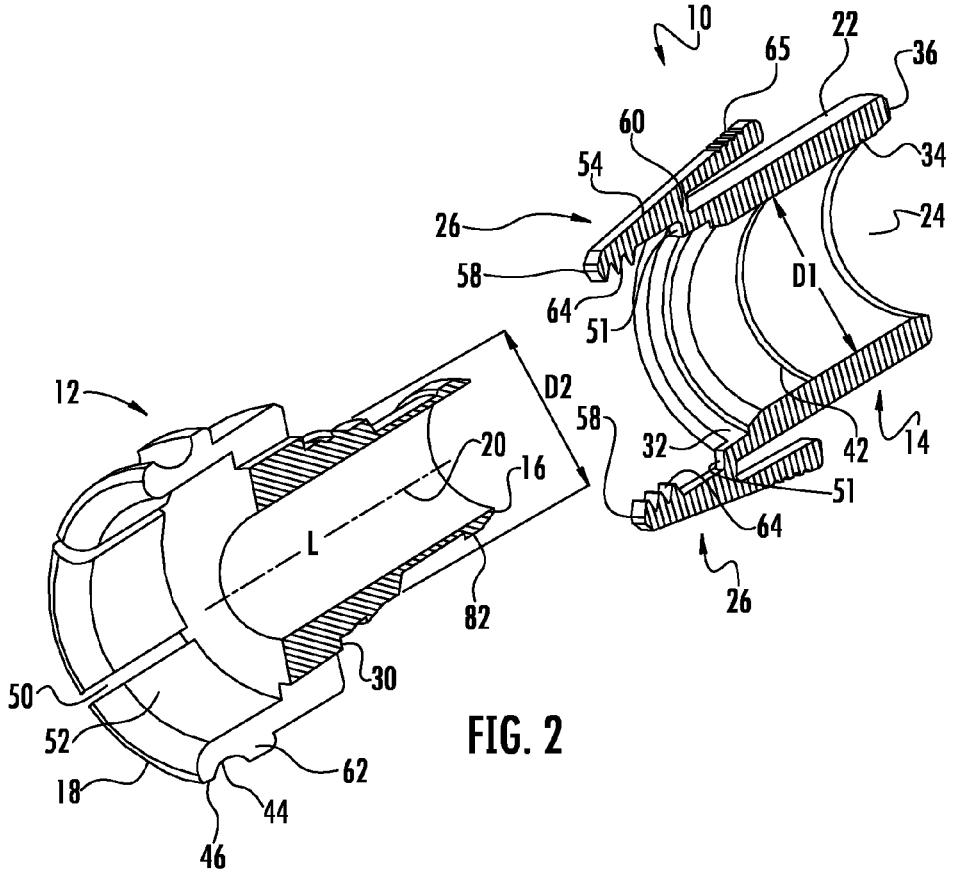
FIG. 2 is an exploded perspective view of the connector of FIG. 1 with the coupler and the retainer shown in a separated orientation.

FIG. 2 illustrates an exploded perspective view of the connector 10 with the coupler 12 and the retainer 14 shown in a separated orientation. Reference will be made to FIG. 2 in addition to FIG. 1 to describe the assembly of the coupler 12 and the retainer 14. In this embodiment, the retainer 14 has a base 22 with a first end 36, a second end 51, and an internal channel 24 and a latching assembly 26. The channel 24 of the base 22 has a diameter "D1" that is larger than the outer diameter "D2" of the first end 16 of the coupler 12. This allows the first end 16 of the coupler 12 to mount within the channel 24. In this regard, once the cable is attached to the coupler 12, as will be described below with reference to FIG. 5, the coupler 12 and the retainer 14 may be assembled by inserting the first end 16 of the coupler 12 into the channel 24 from the end of the base 22 that would be proximal to the component to which the cable is being connected, for example the equipment port of an appliance. An annular shoulder 28 having a forward facing surface 29 and a rearward facing surface 30 is formed in the first end 16 of the coupler 12. A tubular post 31 extends from the annular shoulder 28. The first end 16 inserts into the channel 24 until the rearward facing surface 30 of the annular shoulder 28 contacts a forward facing annular surface 32 extending radially inwardly from the inside surface 34 of the channel 24. In this manner, the coupler 12 and the retainer 14 are releasably lock together. An annular barb 38 protrudes from the outside surface 40 of the tubular post 31. The annular barb 38 acts to dig into the material of the retainer 14 when the coupler 12 and the retainer 14 are assembled providing additional means to secure the coupler 12 and the retainer 14 together. Additionally or alternatively, the retainer 14 may have a notch 42 cut into the inside surface 34 of the channel 24. The annular barb 38 may insert into the notch 42 when the coupler 12 and the retainer 14 are assembled.

Figure 3:
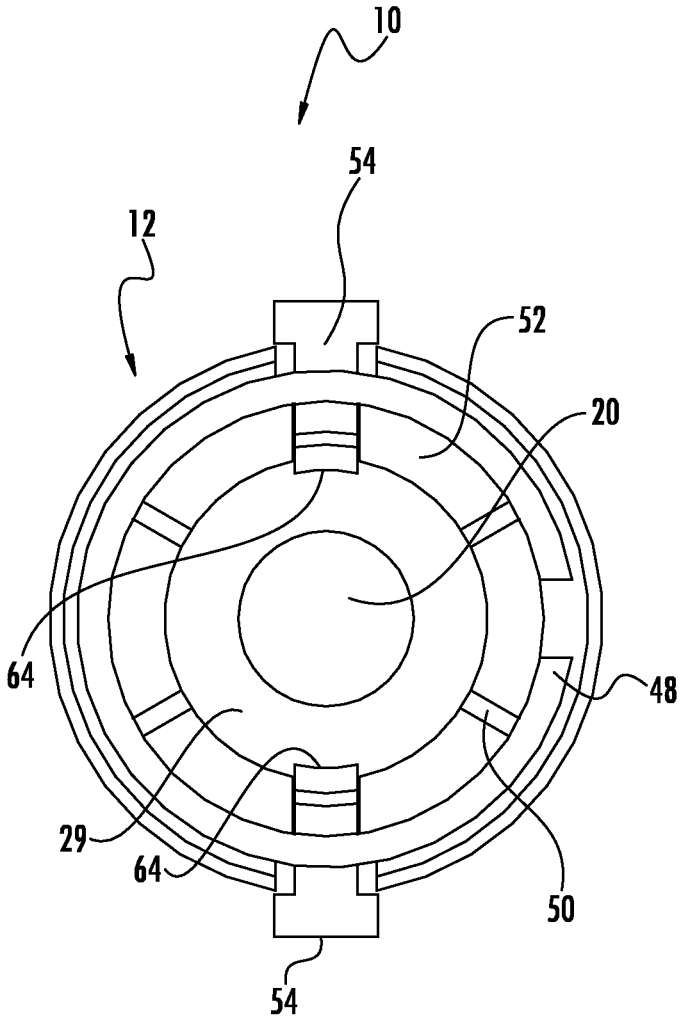
FIG. 3 is a front schematic view of the connector of FIG. 1.
Figure 4:
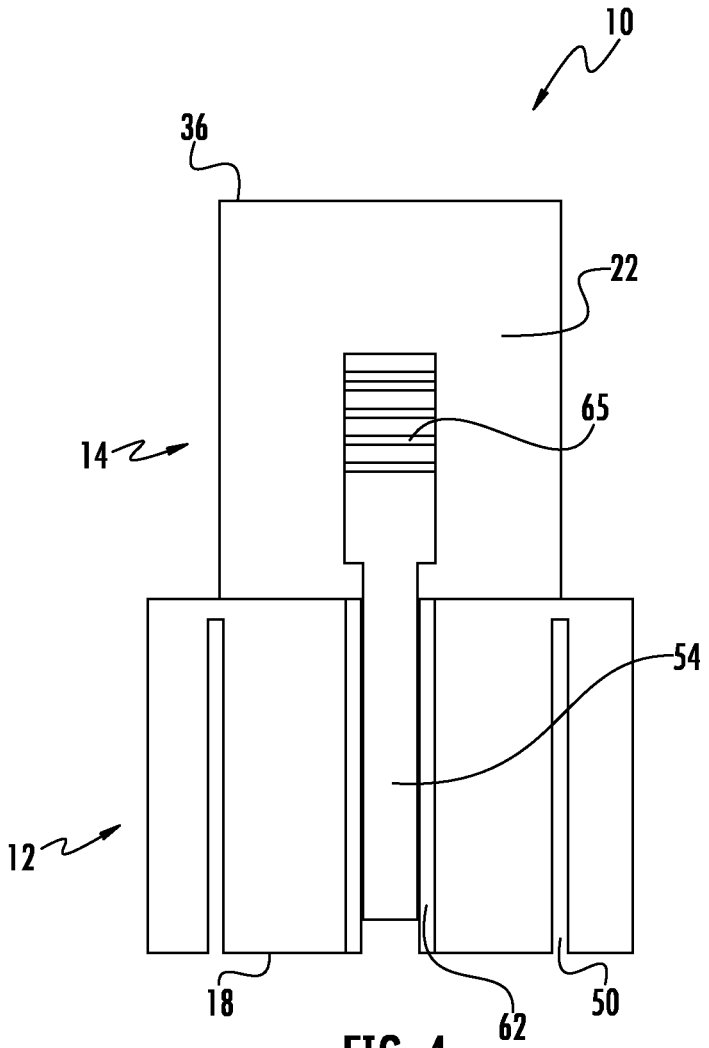
FIG. 4 is a top schematic view of the connector of FIG. 1.

FIG. 3 and FIG. 4 illustrate front schematic and top schematic views, respectively, of connector 10. Reference will be made to FIGS. 3 and 4, in addition to FIG. 1 to further describe the coupler 12. The second end 18 of the coupler 12 is adapted to receive a component, such as, for example, an equipment port of an appliance to which the cable is being connected by the connector 10. The second end 18 is radially inwardly biased allowing the second end 18 to radially compress around a component received by, or inserted into, the coupler 12. In this way, the coupler 12 provides a resilient friction fit function to the component. Referring again to FIG. 1, the second end 18 of the coupler 12 has an annular groove 44 cut circumferentially into the outer surface 46 of the coupler 12. A spring clip 48 fits into the annular groove 44 such that the spring clip 48 extends at least partially around the outer surface 46 of the coupler 12 and provides a radially, inwardly bias to the second end 18 of the coupler 12. Additionally, the coupler 12 may have least one compression slot 50 resulting in one or more coupler sections 52. The coupler sections 62 respond to the radially inwardly bias of the coupler 12, moving or forced toward the longitudinal axis "L" of the bore 20, allowing the second end 18 of the coupler 12 to compress radially inwardly. In this manner, the coupler 12 provides a friction fit function to a component, such as, for example, an equipment port of an appliance, received by the second end 18 of the coupler 12. In other words, by the connector 10 being pushed onto the equipment port, the equipment port is resiliently friction fit to the coupler 22, and, thereby, to the connector 10, without the need for rotating any portion of the connector 10. Further, since the equipment port and the connector 10 are resiliently friction fit to each other, the connector 10 can be released or removed from the equipment port by just pulling the connector 10 from the equipment port, without having to rotate any portion of the connector 10.

Continuing with reference to FIGS. 1, 3 and 4, the latching assembly 26 comprises a beam 54 having a first end 56, a second end 58, and a flexible portion 60 therebetween. The latching assembly 26 pivotably connects to the base 22 at the flexible portion 60 of the beam 54. The connection of the beam 54 to the base 22 at the flexible portion 60, allows the beam 54 to pivot when a force is applied to one of the first end 56 and second end 58. As can be seen best with reference to FIG. 1, an initial orientation of beam 54 is angled downwardly with respect to the second end 58 such that the second end 58 is closer to the bore 20 than the first end 56. The coupler 12 has at least one latch slot 62. Teeth 64 extend radially inwardly from the second end 58 of the beam 54 toward the bore 20, or a point internal to the bore 20 through the latch slot 62. While in FIGS. 1 and 3 the latching assembly 26 is shown as having two beams 54, any number of beams 54, including one, may be included or used. Additionally, there may be one latch slot 62 for each beam 54.

The latching assembly 26 may be biased to a first position. In this embodiment, the first position is the initial orientation with the second end 58 of the beam 54 angled downwardly, although the latching assembly 26 may be biased in other initial orientations. However, when a force is applied to the latching assembly 26, the latching assembly 26 pivots in a direction moving from the first position. When the force is removed from the latching assembly 26, the latching assembly pivots in an opposite direction moving back toward the first position. The first position may be a latched position or an un-latched position. In this manner, the latching assembly 26 is adapted to automatically engage an equipment port inserted into the second end 18 of the coupler 12, and to releasably retain the retainer 14, and thereby, the connector 10 to the equipment port.

Figure 5:
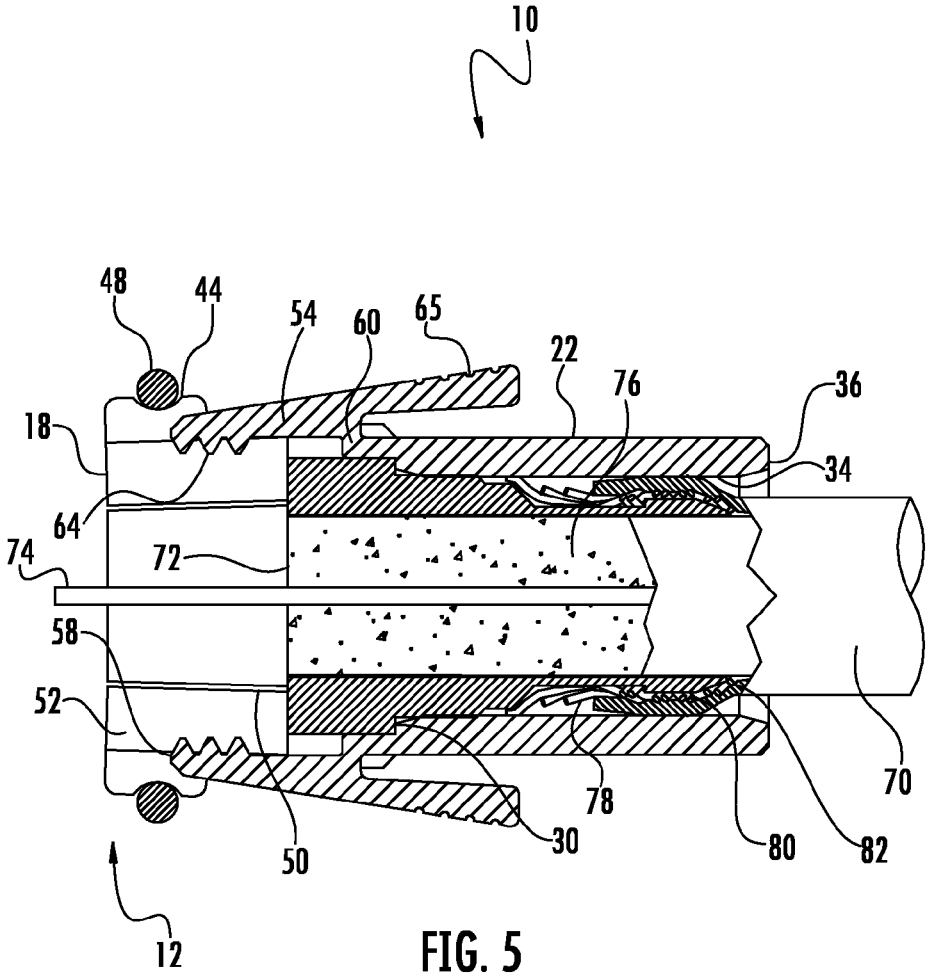
FIG. 5 is a cross-sectional view of the connector of FIG. 1 with a cable installed therein.

FIG. 5 is a cross-sectional view of the connector 10 with a cable 70 installed therein. The first end 16 of the coupler 12 is adapted to receive an end 72 of the cable 70. In FIG. 5, the cable 70 is shown as a coaxial cable. The cable 70 has center conductor 74. The center conductor 74 is surrounded by a dielectric material 76, and the dielectric material 76 is surrounded by an outer conductor 78 that may be in the form of a conductive foil and/or braided sheath. The outer conductor 78 is usually surrounded by a plastic cable jacket 80 that electrically insulates, and mechanically protects, the outer conductor 78. A prepared end of the coaxial cable 70 is inserted through the first end 34 of the channel 24 and onto the tubular post 31. A compression tool (not shown) may be used to feed the cable 70 into the coupler 12 of the connector 10 such that a raised area 82 extending from the tubular post 31 of the coupler 12 inserts between the dielectric material 76 and the outer conductor 78 of the cable 70, making contact with the outer conductor 78. The center conductor 74 extends through the bore 20 of the coupler 12 to and through the second end 18. The compression tool may also be used to advance the retainer 14 over the first end 16 of the coupler 12. As the retainer 14 advances over the first end 16 of the coupler 12, the inside surface 34 of the channel 24 squeezes against the cable jacket 78. In this manner, the cable 70 is retained in the connector 10. Additionally, the raised area 82 positioned between the dielectric material 76 and the outer conductor 78 acts to maximize the retention strength of the cable jacket 80 within the connector 10. As the retainer 14 moves toward the second end 18 of the connector 10, the retainer 14 causes the cable jacket 80 to be pinched between the inside surface 34 of the channel 24 and the raised area 82 increasing the pull-out force required to dislodge cable 70 from the connector 10. Since the outer conductor 78 is in contact with the first end 16 of the coupler 12 an electrically conductive path is established from the outer conductor 78 through the coupler 12 and, thereby, to the equipment port (not shown in FIG. 5).

Figure 6A:
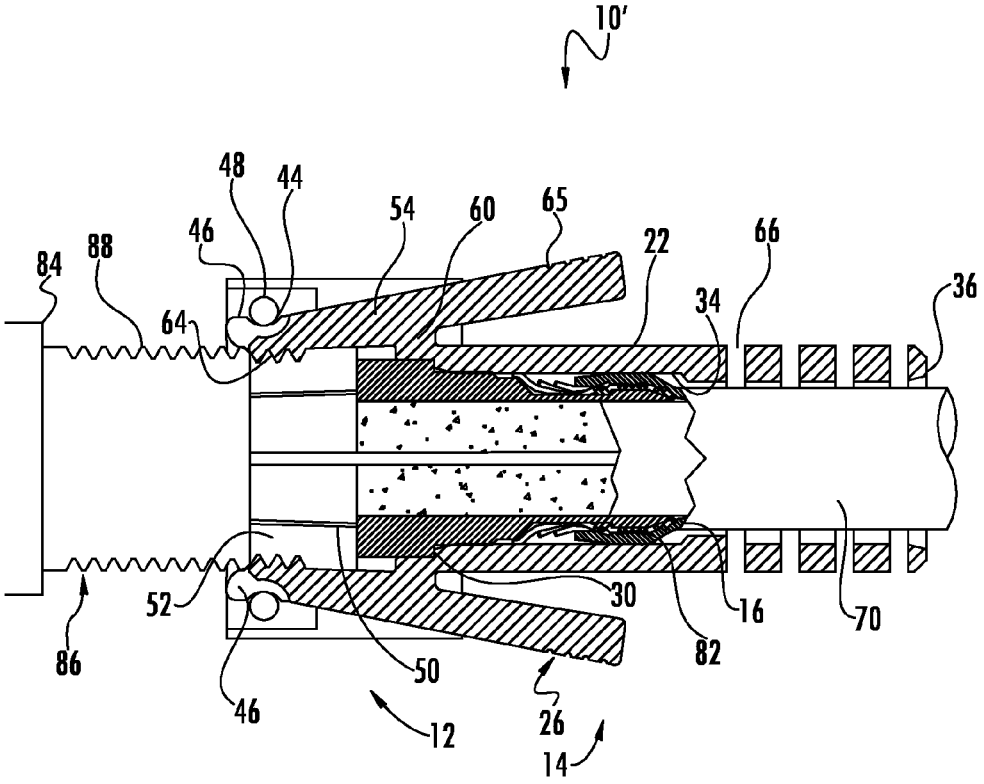
FIGS. 6A, 6B and 6C are partial cross-sectional views of the connector with strain relief and with a cable installed therein and in different states of connection to an equipment port.
Figure 6B:
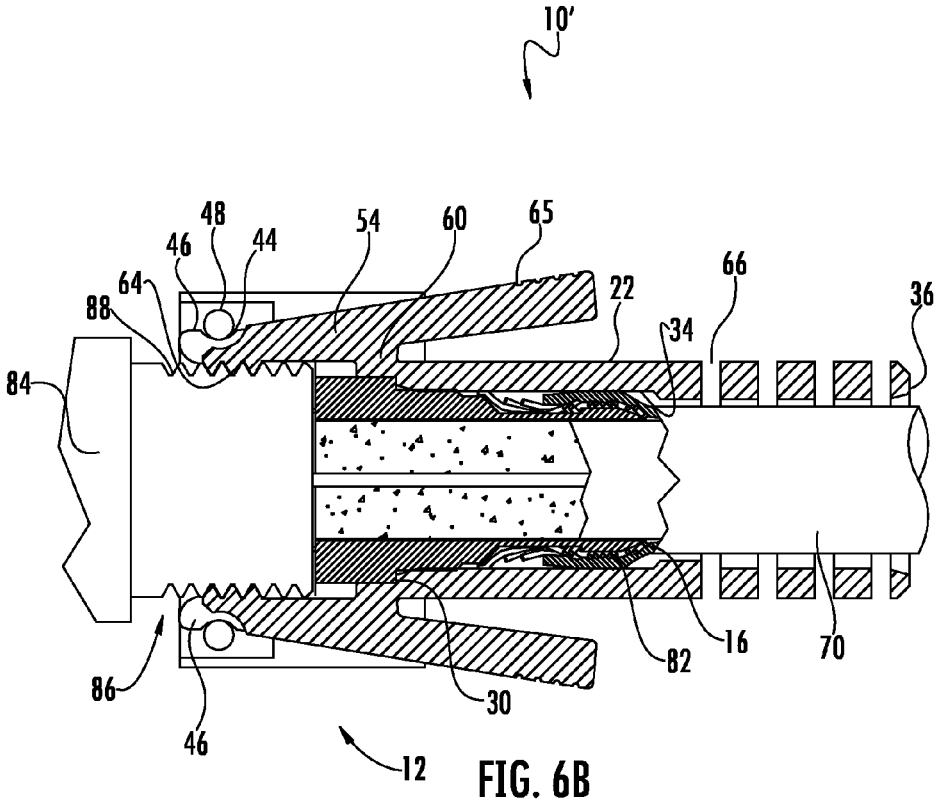
Figure 6C:
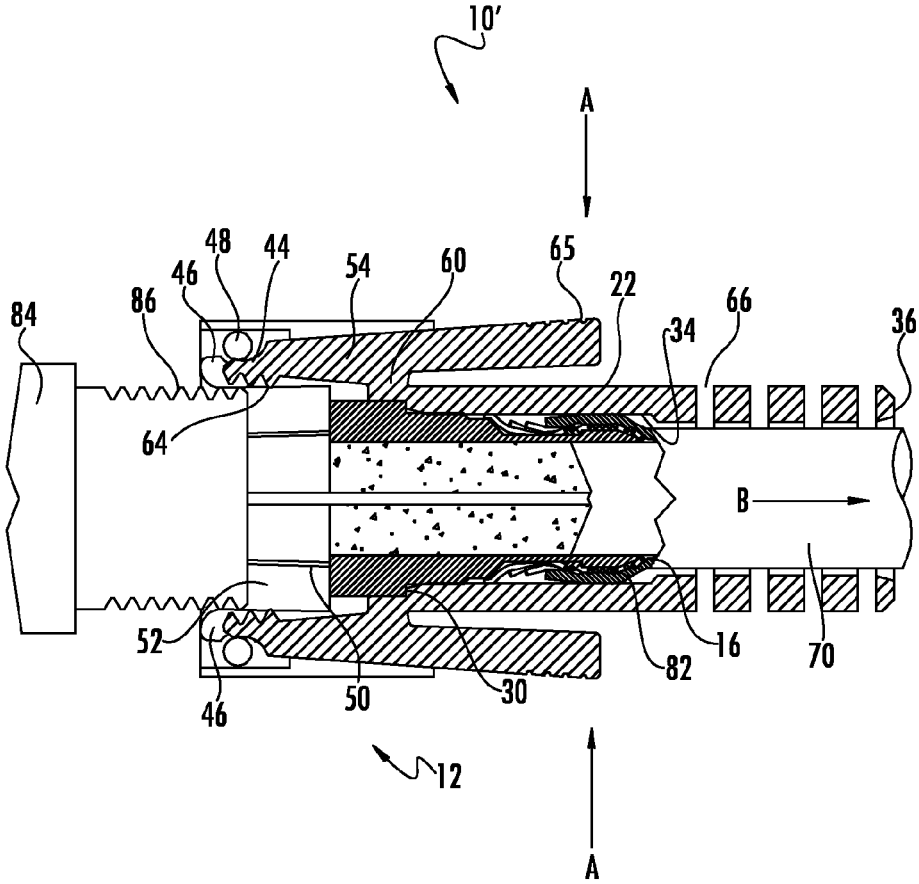

FIGS. 6A, 6B and 6C are partial cross-sectional views of the connector 10' with a cable 70 installed therein and in relation to an equipment port 84. Additionally, the base 22 of the retainer 14 has a first end 56 formed as a series of strain relief slots 66 to provide strain relief for the cable 70. FIG. 6A illustrates the connector 10' as partially connected to the equipment port 84. The center conductor 74 of the cable 70 engages with the equipment port 84 as the second end 18 of the coupler 12 receives threaded portion 86 of the equipment port 84. At this point, there is electrical and mechanical communication between the connector 10' and the equipment port 84. Additionally, the compression slots 50 allow the coupler sections 52 to flex radially outwardly as the coupler 12 receives the equipment port 84. Even though the coupler sections 52 flex radially outwardly, the coupler 12 continues to exert a radially inward bias as urged on by the spring clip 48. Also, the inherent resiliency of the material of the coupler 12 promotes the radially inward bias.

FIG. 6B illustrates the connector 10' in a position advanced axially toward the equipment port 84. As the connector 10' advances, the second end 18 of the coupler 12 receives the equipment port 84 such that the threaded portion 86 is friction fitted within the bore 20 due to the radially inward bias of the coupler 12. Additionally, as the threaded portion 86 contacts the teeth 64 extending from the second end 58 of the beam 54, the threaded portion 86 forces the teeth 64 to move causing the beam 54 to pivot about the flexible portion 60 from a first position. In this manner, the teeth 64 are allowed to advance over the threaded portion 86 until the equipment port 84 stops advancing, for example, when the equipment port 84 contacts the forward facing surface 29 of the annular shoulder 28. At that point, the beam 54 pivots back toward the first position allowing the teeth 64 to engage one or more of the threads 88 of the threaded portion 86, latching the retainer 14, and, thereby, the connector 10, to the equipment port 84. Thus, in addition to the friction fit of the coupler 12 on to the threaded portion 86 of the equipment port 84, the latching assembly 26 latches the connector 10' to the equipment port 84 causing an increasing resistance to disengagement of the connector 10' from the equipment port 84. The connector 10' may remain latched to the connector port 84 until intentionally unlatched. Moreover, in this manner, the coupler 12 and the retainer 14 provide that at any point of engagement between connector 10' and equipment port 84 a reliable ground path and RF shield is established, ensuring proper electrical function.

FIG. 6C illustrates the connector 10' partially uninstalled from the equipment port 84. A grip portion 65 is located on the first end 56 of the beam 54. An unlatching force "A" may be applied to the grip portion 65 of the first end 56 of the beam 54. Unlatching force "A" may pivot the beam 54 thereby disengaging the teeth 64 from the threads 88 of the equipment port 84. Once the teeth 64 are disengaged from the threads 88, a pull-out force "B" applied to the retainer 14 will overcome the compression providing the friction fit of the coupler 12 to the equipment port 84, thereby, axially moving away or withdrawing the connector 10' from the equipment port 84. In this manner, the connector 10' may be released and/or detached from the equipment port 84.

Figure 7:
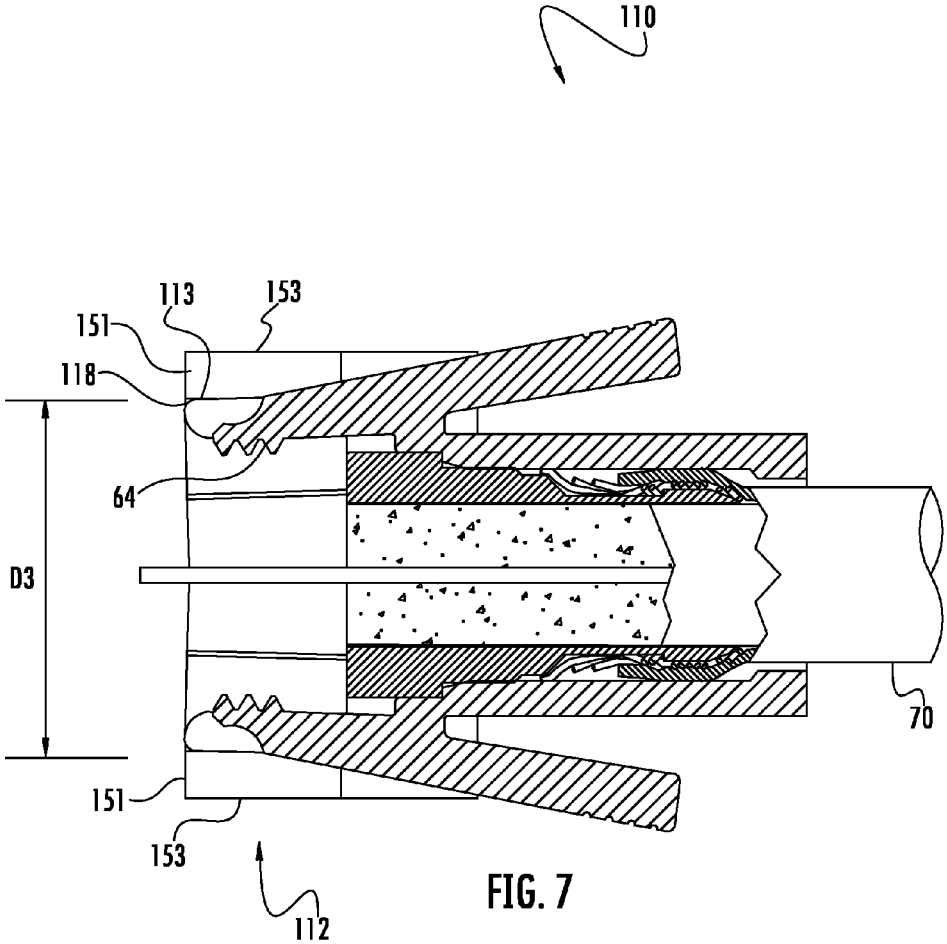
FIG. 7 is a cross-sectional view of an exemplary embodiment of a connector.
Figure 8:
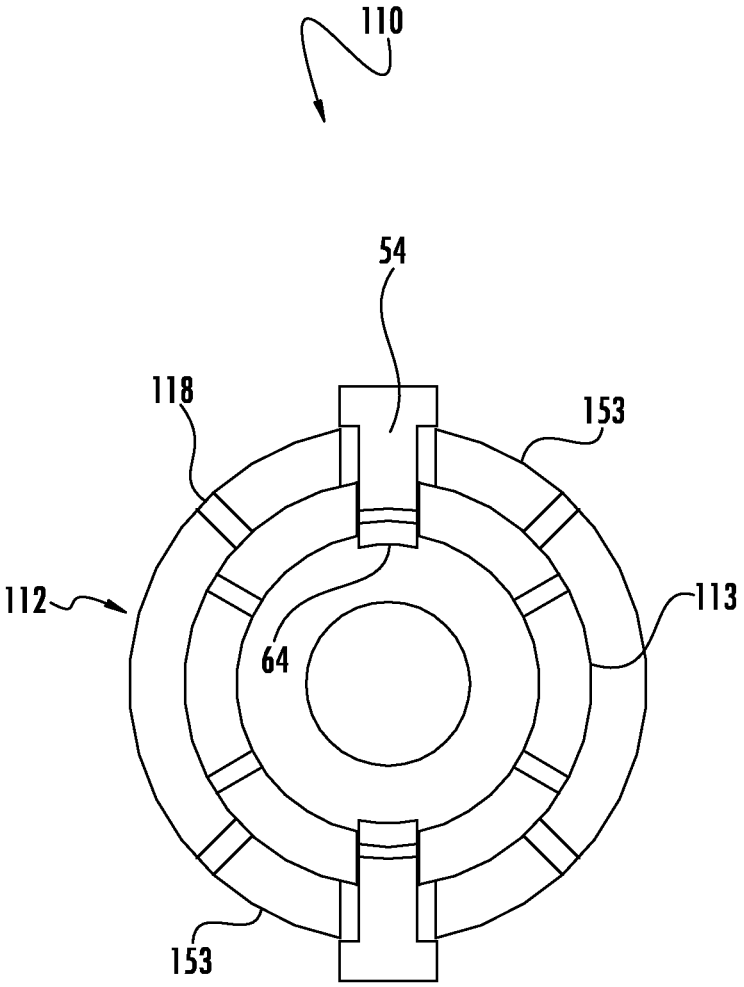
FIG. 8 is a front schematic view of the connector of FIG. 7.

FIG. 7 is a cross-sectional view of another exemplary embodiment of a connector 110. FIG. 8 is a front schematic view of connector 110. Connector 110 is similar to connector 10 except that connector 110 does not have a spring clip 40. Instead, the second end 151 of the base 122 of the retainer 114 has outer fingers 153 that extend over the second end 118 of the coupling 112. The outer fingers 153 have an inner diameter "D3" sized such that the inside surface 113 of the outer fingers 153 provides a radially inwardly bias on the coupling 112 resulting in the friction fit function for retaining the equipment port 84 in the coupler 112. In other words, because of the size of the inner diameter "D3", the natural resiliency of the material of the coupler 112 is sufficient to provide an effective radially inwardly biasing such that a spring clip 48 is not needed. The latching assembly 26 functions in the same manner as described above for connector 10.

Figure 9:
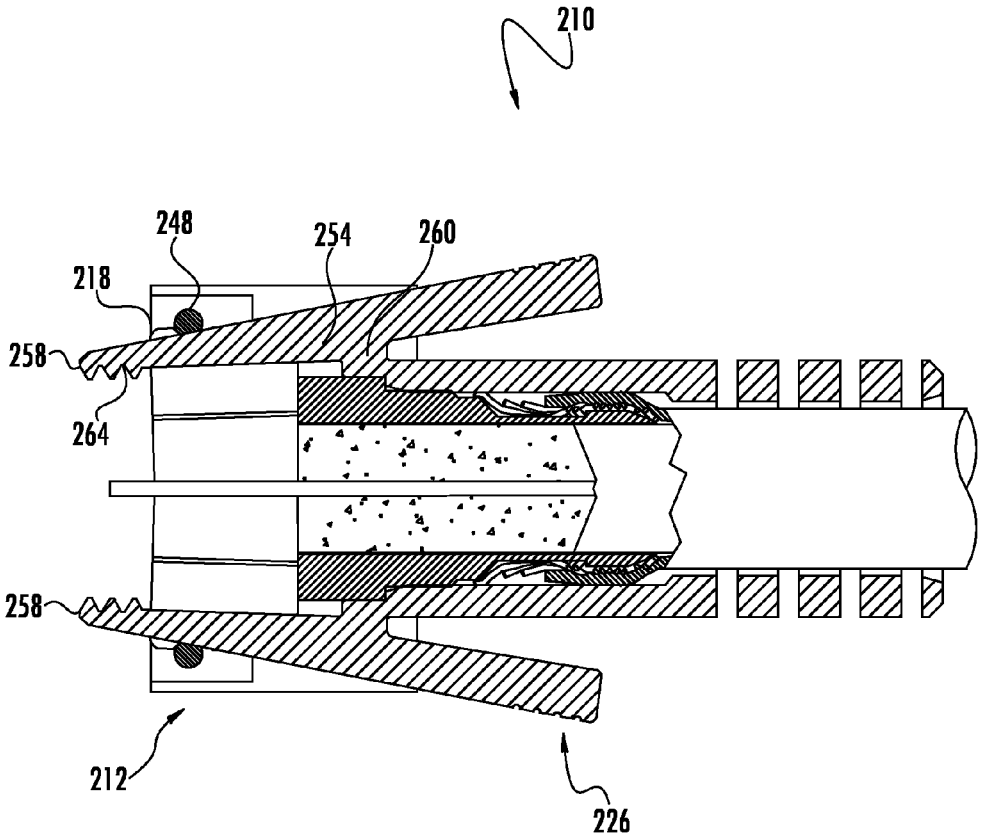
FIG. 9 is a cross-sectional view of an exemplary embodiment of a connector with a latching assembly having teeth that extend past the connector and a coupler with a spring clip.
Figure 10:
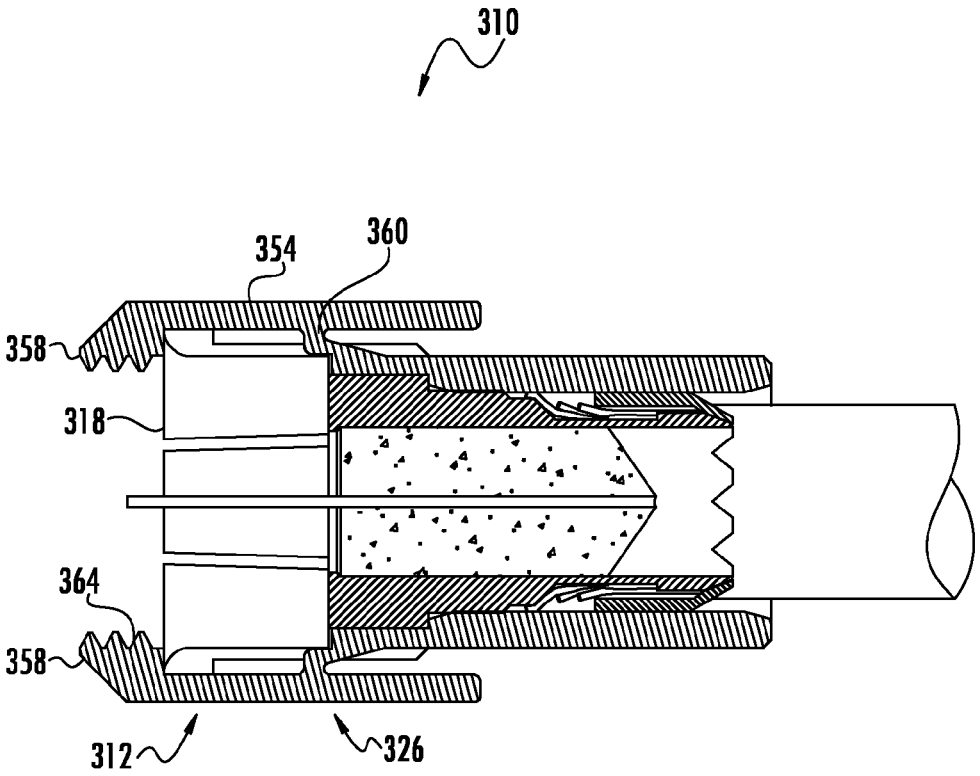
FIG. 10 is a cross-sectional view of an exemplary embodiment of a connector with latching assembly having teeth that extend past the connector and a coupler without a spring clip.

FIG. 9 and FIG. 10 are cross-sectional views of exemplary embodiments of connectors 210, 310 with latching assemblies 226, 326 having teeth 264, 364 that extend past the second end 218, 318 of the connector 210, 310. FIG. 9 illustrates a connector 210 with a spring clip 248, while FIG. 10 illustrates a connector 310 without a spring clip. The latching assemblies 226, 326 have beams 254, 354 with a flexible portions 260, 360 that allow the beams 254, 354 to pivot in the same manner as described with respect to connector 10. However, the beams 254, 354 have second ends 258, 358 that extend farther from the flexible portions 260, 360 resulting in the teeth 264, 364 being out from the coupler 212, 312. Therefore, the teeth 264, 364 will contact the equipment port 84 before the couplers 212, 312. In this way, connectors 210, 310 can also accommodate equipment ports 84 having longer threaded portions 86.

Figure 11:
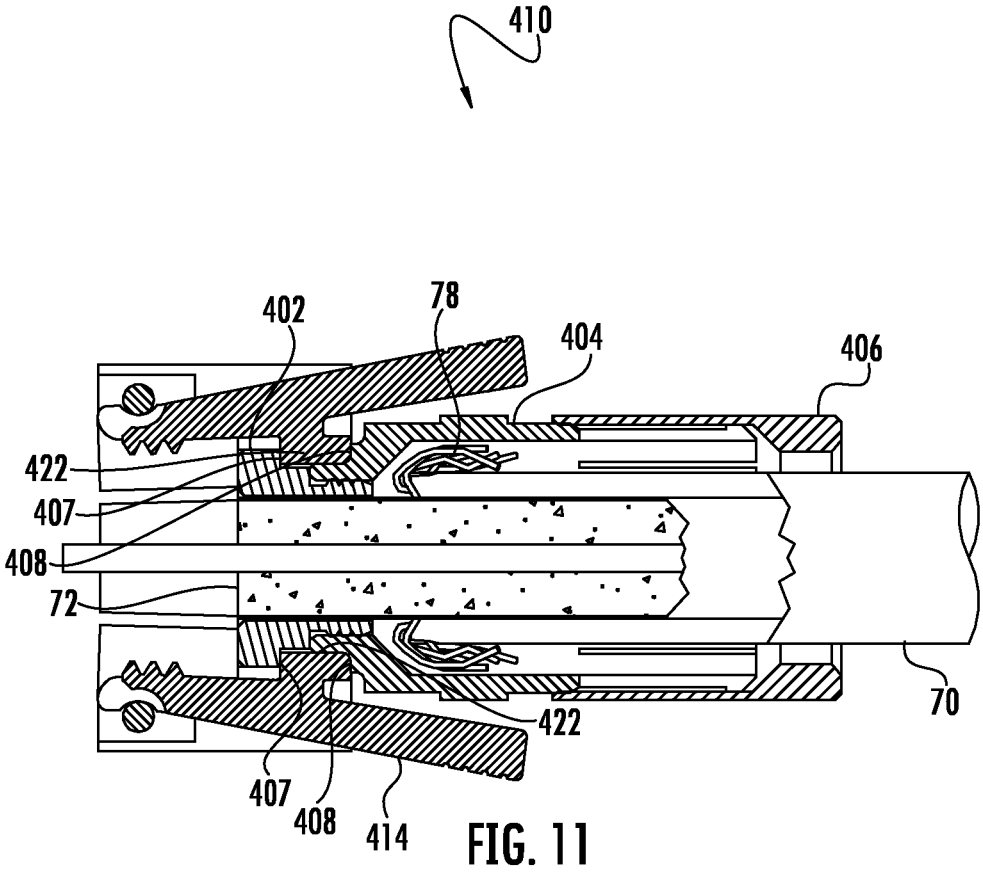
FIG. 11 is a cross-sectional view of an exemplary embodiment of post-less connector with a coupler and a retainer.
Figure 12A:
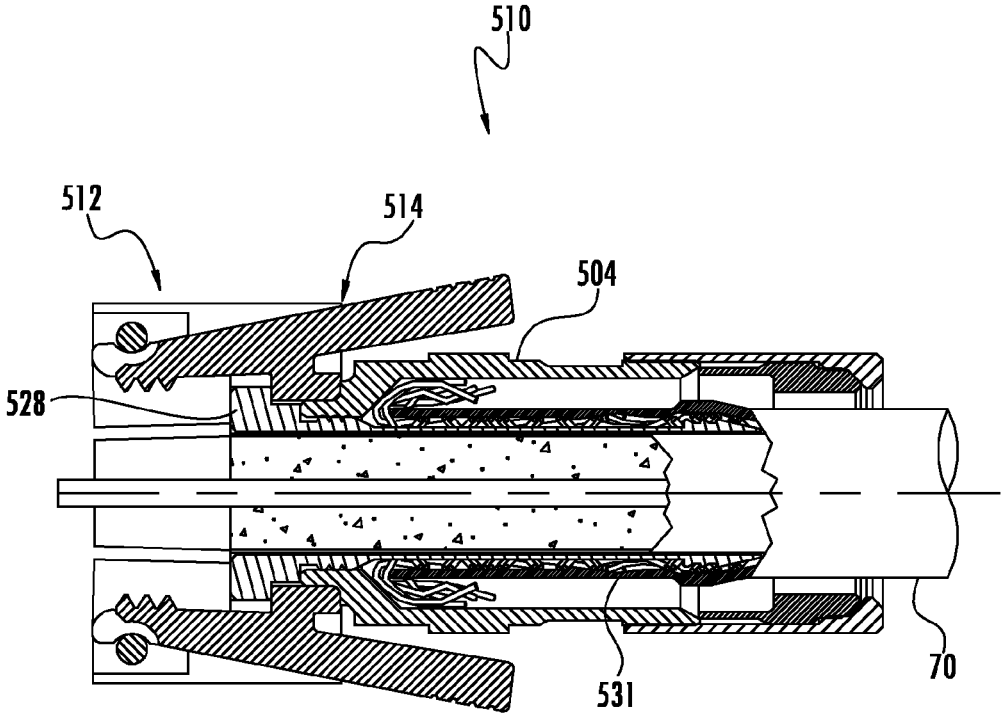
FIGS. 12A-12E are cross-sectional views of exemplary embodiments of connectors with couplers and retainers.
Figure 12B:
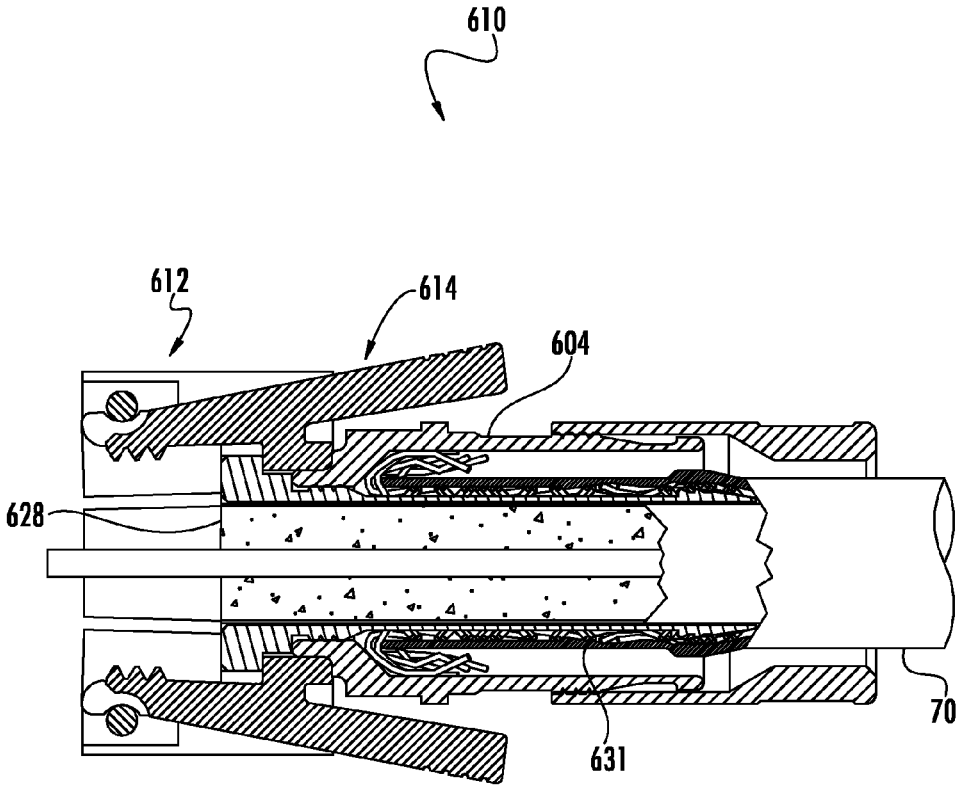
Figure 12C:
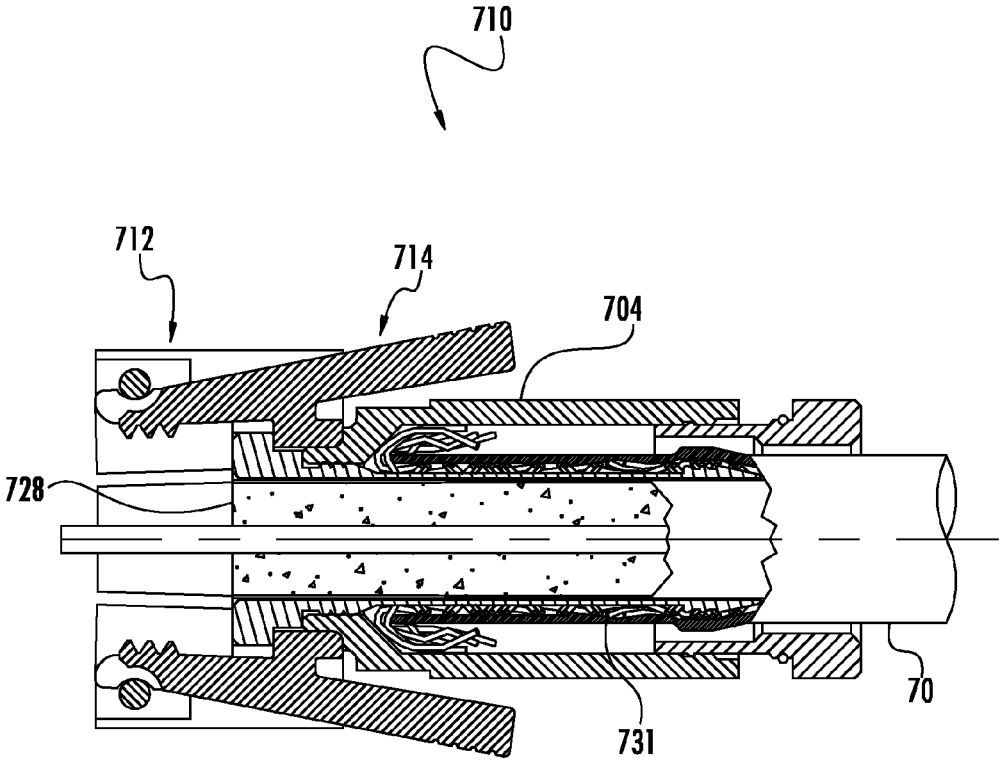
Figure 12D:
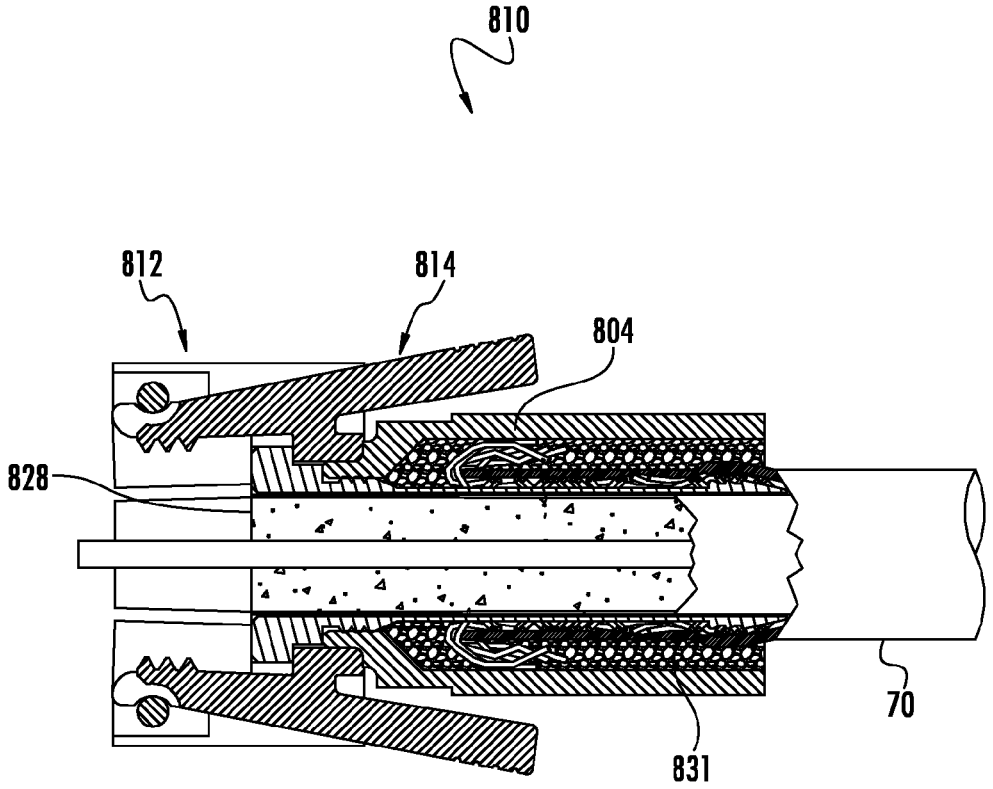
Figure 12E:
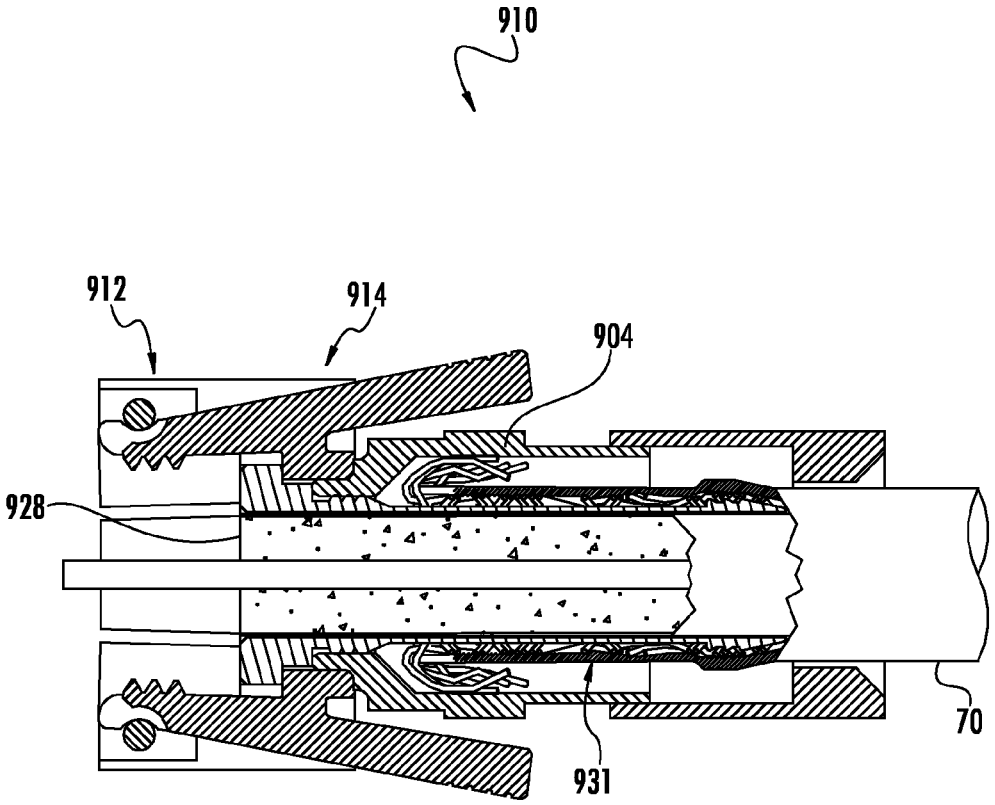

FIG. 11 is a cross-sectional view of a post-less connector 410. The first end 416 of the coupler 412 is not a tubular post, but is a collar 402. Therefore, instead of a tubular post inserting between the dielectric material 76 and the outer conductor 78 of a cable 70 inserted into the connector 410, the prepared end 72 of the cable 70 extends through a body 404 to the collar 402. A shell 406 slides over the body 404 and compresses the body against the outer conductor 78 and the cable jacket 80. In this manner, the cable 70 is retained in the connector 410. The base 422 of the retainer 414 positions between opposite faces 407, 408 of the collar 402 and the body 404, respectively. As the shell 406 is slid over the body 404, the body 404 moves toward the collar 402 thereby squeezing the base 422 between the opposite faces 407, 408. In this manner, the retainer 414 is releasably attached to the coupler 412, and, thereby, the connector 410. The coupler 412 receives the equipment port 84 or other component and the retainer latches and unlatches the equipment port 84 in the same manner as described above.

FIGS. 12A-12E illustrate other embodiments of connectors 510, 610, 710, 810 and 910 which include couplers 512, 612, 712, 812 and 912 and retainers 514, 614, 714, 814 and 914. The couplers 512, 612, 712, 812 and 912 have tubular posts 531, 631, 731, 831 and 931 that extend from annular shoulder 528, 628, 728, 828 and 928. The connectors 510, 610, 710, 810 and 910 have bodies 504, 604, 704, 804 and 904. The retainers 514, 614, 714, 814 and 914 attach to the connectors 510, 610, 710, 810 and 910 by the bases being captured between opposing faces of the annular shoulders 528, 628, 728, 828 and 928 and the bodies 504, 604, 704, 804 and 904 in a similar manner as described above with respect to FIG. 11. Additionally, the couplers 512, 612, 712, 812 and 912 and retainers 514, 614, 714, 814 and 914 engage and latch to an equipment port in the same manner as described above with respect to other embodiments.

Many modifications and other embodiments set forth herein will come to mind to one skilled in the art to which the embodiments pertain having the benefit of the teachings presented in the foregoing descriptions and the associated drawings. Therefore, it is to be understood that the description and claims are not to be limited to the specific embodiments disclosed and that modifications and other embodiments are intended to be included within the scope of the appended claims.

It is intended that the embodiments cover the modifications and variations of the embodiments provided they come within the scope of the appended claims and their equivalents. Although specific terms are employed herein, they are used in a generic and descriptive sense only and not for purposes of limitation.

What is claimed is:

1. A cable connector, comprising:

a coupler comprising first and second ends and at least one latch slot, wherein the coupler is radially inwardly biased;

a retainer attached to the coupler, the retainer having a pivotable latching assembly a beam having first and second ends and a plurality of comprising teeth adapted to engage a thread of an equipment port and extending radially inwardly towards a bore of the coupler, wherein the second end of the beam and at least one of the plurality of teeth extend radially inwardly through the at least one latch slot in the second end of the coupler into the bore of the coupler and the latching assembly is biased in a latched position such that, when a force is applied to a grip portion of the latching assembly, the latching assembly pivots in a direction moving from the latched position, and when the force is removed from the latching assembly, the latching assembly pivots in an opposite direction moving toward the latched position.

2. The cable connector of claim 1, wherein, in the latched position, the latching assembly is adapted to automatically engage an equipment port and releasably retain the equipment port when the equipment port is received by the connector.

3. The cable connector of claim 1, wherein:

the latching assembly of the retainer is pivotably connected to a base of the retainer at a location on the beam between the first end and the second end of the beam;

and in the latched position, an end of the latching assembly beam and at least one of the latching assembly teeth extend radially inwardly through the at least one latch slot in the second end of the coupler into the bore of the coupler such that, when a force is applied to a grip portion of the latching assembly, the latching assembly pivots in a direction moving from the latched position.

4. The cable connector of claim 1, wherein the radially inward bias of the coupler allows the coupler to provide a resilient friction fit function.

5. The cable connector of claim 1, wherein the coupler is adapted to receive an equipment port such that the coupler is resiliently friction fitted to the equipment port.

6. The cable connector of claim 1, wherein the latching assembly is adapted to automatically engage an equipment port received by the cable connector.

7. The cable connector of claim 6, wherein the latching assembly is adapted to releasably retain the equipment port to the retainer.

8. The cable connector of claim 7, wherein the latching assembly is adapted to engage a thread of the equipment port.

9. The cable connector of claim 1, wherein the coupler has a first end and a second end.

10. The cable connector of claim 9, and wherein the first end is adapted to receive an end of a cable.

11. A cable connector, comprising:

a coupler having a first end, a second end comprising at least one latch slot, and a bore extending therethrough, wherein the second end is radially inwardly biased;

a retainer having a base with an internal channel, and a latching assembly pivotably connected to the base, wherein the latching assembly of the retainer comprises a beam having first and second ends, the first end of the coupler is positioned within the internal channel of the base, the latching assembly comprises a plurality of teeth extending radially inwardly from the second end of the beam through the latch slot in the second end of the coupler towards the bore of the coupler proximate to the second end of the coupler; and the latching assembly is biased in a latched position such that, when a force is applied to a grip portion of the latching assembly, the latching assembly pivots in a direction moving from the latched position and the latching assembly is adapted to automatically engage an equipment port and releasably retain the equipment port when the equipment port is received by the connector.

12. The cable connector of claim 11, wherein the latching assembly is configured to automatically latch the retainer using at least one of the plurality of teeth.

13. The cable connector of claim 11, wherein the latching assembly is configured to unlatch the retainer by applying a force to the latching assembly.

14. The cable connector of claim 11, wherein the latching assembly pivotably connects to the base at a location on the beam between the first end and the second end.

15. The cable connector of claim 14, wherein the first end of the beam has a grip portion adapted for receiving force applied to the beam for pivoting the beam and unlatching the retainer.

16. The cable connector of claim 11, wherein the first end of the coupler comprises a tubular post, wherein the tubular post extends in the channel and, wherein the tubular post is adapted to receive an end of a cable.

17. The cable connector of claim 11, further comprising a spring clip, wherein the spring slip attaches at least partially around the coupler and provides the radially inwardly bias to the coupler.

18. The cable connector of claim 11, wherein the first end of the coupler is adapted to receive an equipment port such that the equipment port is resiliently friction fitted to the cable connector.

19. The cable assembly of claim 11, wherein the latching assembly is adapted to engage a thread of the equipment port.

20. The cable assembly of claim 19, wherein the at least one of a plurality of teeth engages a thread of the equipment port.

21. A cable connector comprising a coupler and a retainer, wherein:

the retainer comprises a base and a latching assembly;

the base of the retainer comprises an internal channel;

the coupler comprises a first end, a second end, and a bore extending therethrough;

the first end of the coupler is positioned within the internal channel of the retainer;

the second end of the coupler is radially inwardly biased;

the latching assembly of the retainer comprises a beam having a first end and a second end and is pivotably connected to the base at a location on the beam between the first end and the second end of the beam;

the latching assembly comprises a plurality of teeth extending radially inwardly from the second end of the beam towards the bore of the coupler proximate to the second end of the coupler;

the second end of the coupler comprises at least one latch slot;

the second end of the beam and at least one of the plurality of teeth extend radially inwardly through the at least one latch slot in the second end of the coupler into the bore of the coupler.

22. The cable connector of claim 21, wherein the beam comprises a plurality of beams.

23. The cable connector of claim 21, wherein the coupler has an annular groove, and wherein a spring clip positions in the annular groove at least partially around the coupler and provides the radially inwardly bias to the coupler.

24. The cable connector of claim 21, wherein the coupler has at least one compression slot, wherein the at least one compression slot responds to the radially inwardly bias of the coupler providing a resiliently friction fit function to the coupler.

25. The cable connector of claim 21, wherein at least one of the plurality of teeth extends past the second end of the body.

26. The cable connector of claim 21, wherein the base of the retainer comprises one or more strain relief slots to provide strain relief to a cable installed in the cable connector.

27. The cable connector of claim 21, wherein the latching assembly is biased in a latched position where the second end of the beam and at least one of the plurality of teeth extend radially inwardly through the at least one latch slot in the second end of the coupler into the bore of the coupler such that, when a force is applied to a grip portion of the latching assembly, the latching assembly pivots in a direction moving from the latched position.

28. The cable connector of claim 27, wherein, in the latched position, the latching assembly is adapted to automatically engage an equipment port and releasably retain the equipment port when the equipment port is received by the connector.

* * * * *